US006375111B1

(12) United States Patent
Mycielski et al.

(10) Patent No.: US 6,375,111 B1
(45) Date of Patent: Apr. 23, 2002

(54) APPARATUS FOR HIGH SPEED BEAMING OF ELASTOMERIC YARNS

(75) Inventors: Jacek Zygmunt Mycielski, Mherr; Gerardus Van Den Hoven, Alphen; Frederick Jan Groot, Anna Paulowna; Johannes Leonardus Jozefus Brouwers, Noorbeek, all of (NL)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/589,655

(22) Filed: Jun. 8, 2000

Related U.S. Application Data

(62) Division of application No. 09/189,336, filed on Nov. 10, 1998, now Pat. No. 6,126,102.

(51) Int. Cl.[7] ..... B65H 23/18; B65H 63/00; G01L 1/16

(52) U.S. Cl. ..... 242/417.3; 28/187; 28/212; 73/862.473

(58) Field of Search ..... 242/417.3, 154; 28/185–189, 194, 212; 73/862.44, 862.473

(56) References Cited

U.S. PATENT DOCUMENTS

| | | | | |
|---|---|---|---|---|
| 2,995,316 A | * | 8/1961 | Burnell | 242/147 R |
| 3,612,791 A | * | 10/1971 | Porter | 200/61.18 |
| 3,800,162 A | * | 3/1974 | Lueck et al. | 28/187 X |
| 4,100,425 A | | 7/1978 | Ohsawa | |
| 4,169,981 A | * | 10/1979 | White et al. | 28/187 X |
| 4,353,227 A | * | 10/1982 | Shields et al. | 66/146 |
| 4,407,767 A | * | 10/1983 | Seaborn | 28/187 X |
| 4,525,905 A | | 7/1985 | Bogucki-Land | |
| 4,610,059 A | * | 9/1986 | Seaborn et al. | 28/187 |
| 4,651,938 A | | 3/1987 | Memminger et al. | |
| 4,710,646 A | * | 12/1987 | Curda et al. | 28/187 X |
| 5,447,181 A | * | 9/1995 | Tahara et al. | 139/192 |
| 5,454,151 A | * | 10/1995 | Bogucki-Land et al. | 28/194 |
| 5,544,503 A | * | 8/1996 | Miyamoto | 66/146 |
| 6,053,216 A | * | 4/2000 | Debaes et al. | 242/150 R |
| 6,126,102 A | * | 10/2000 | Mycielski et al. | 28/194 X |

FOREIGN PATENT DOCUMENTS

| | | |
|---|---|---|
| CH | 676 233 | 12/1990 |
| CH | 165 126 | 11/1993 |
| DE | 444 844 | 5/1927 |
| DE | 28 32 924 | 2/1980 |
| DE | 41 05 181 | 11/1991 |
| DE | 41 19 048 | 12/1992 |
| DE | 29608169 | 10/1997 |
| DE | 19813719 | 10/1998 |
| EP | 0365 471 | 4/1990 |
| EP | 0744483 | 11/1996 |
| FR | 621 975 | 5/1927 |
| FR | 1 248 250 | 3/1961 |
| GB | 922 185 | 3/1963 |
| JP | 7-196247 A * | 8/1995 |

* cited by examiner

*Primary Examiner*—Michael R. Mansen

(57) ABSTRACT

A method is provided for unwinding a cake of wound elastomeric yarn from a creel, passing the elastomeric yarn over a bend in a thread guide and beaming the elastomeric yarn onto a bobbin in a warper head. The method includes the step of positioning the bend in the thread guide so as to contact the elastomeric yarn passing over the bend and change the direction of the elastomeric yarn passing through the thread guide just one time. The thread guide is attached to a base member such that a portion of the thread guide moves in response to changes in tension in the elastomeric yarn. The base member includes a mechanism for monitoring the position of the thread guide, which generates an electrical signal if the thread guide moves beyond a desired range in response to an increase in tension in the elastomeric yarn. The monitoring mechanism may also generate an electrical signal in response to the absence of tension in the elastomeric yarn passing through the thread guide.

7 Claims, 14 Drawing Sheets

185
189
193
195
199
187
191
197
55
61
a
b
e
Y

APPARATUS FOR HIGH SPEED BEAMING OF ELASTOMERIC YARNS

This is a division of application Ser. No. 09/189,336, filed Nov. 10, 1998, now U.S. Pat. No. 6,126,102.

BACKGROUND

1. Field of the Invention

The present invention relates to the field of beaming of elastomeric yarn by unwinding the yarn from cakes in a creel and winding, or beaming, the elastomeric yarn onto a beam in a beaming apparatus.

2. Description of the Related Art

Elastomeric yarn is made by spinning yarn and winding the spun yarn onto a tube to form a cake of elastomeric yarn. Manufacturers of fabrics that include elastomeric yarn require a large number of ends of yarn in order use the yarn in machines to make a fabric, and therefore it is necessary to wind, or warp, a large number of ends from cakes onto a beam to knit or weave the elastomeric yarn into warp-stretch fabrics.

Machines for warping elastomeric yarn are known in the art. Turning to FIG. 1, there is shown a conventional beaming apparatus 11 that include a creel 13, a pre-stretch unit 15, and a warper head 17. Elastomeric yarn is unwound from a large number of cakes 19 in creel 13 where pre-stretch unit 15 produces the pulling force necessary to unwind the yarn from the cakes. The yarn is wound onto a beam in warper head 17.

Creel 13 includes a plurality of cakes, usually from 1000 to 1600. As shown in FIG. 2, cakes 19 have a central core, or tube, 21 around which elastomeric yarn 23 is wound. Typically, creel 13 includes at least one frame with cakes 19 mounted on each frame in long horizontal or vertical rows and in a number of levels or stories above one another. Creel 13 often includes more than one frame in which case the frames are spaced apart either parallel to each other or in some other configuration. Each cake 19 is mounted on a rotatable spool or drive roll and the outer circumferential surface of cake 19, that is, elastomeric yarn 23, is placed in contact with a drive roll 25 that drives the surface of cake 19 in a speed ratio of 1:1 to unwind cake 19. While being unwound, yarn 23 is also subject to a pulling force from pre-stretch unit 15.

Pre-stretch unit 15 includes rolls 27 which pull yarn 23 from creel 13 at a pulling force necessary to assure optimal unwinding of yarn 23. If the pulling force is too high or too low, yarn 23 will unwind incorrectly.

Yarn 23, as it is unwound, typically passes through a thread guide 31 which orients yarn 23 approximately 90 degrees toward pre-stretch unit 15. Thread guide 31 is generally in the shape of a loop called a pigtail, and is made from ceramic.

As yarn 23 exits creel 13, unwound yarn 23 from one level or row of cakes 19 passes through a front guide 33 to orient yarns 23 into a thread sheet. As the threadsheet enters pre-stretch unit 15, yarn 23 is aligned by a separation comb 35 before passing onto rollers 27.

Yarn 23 passes from pre-stretch unit 15 through a reed 37 and then to beam 29. Reed 37 is a comb-like structure that has a base and a plurality of needles connected to the base so as to define spaces therebetween through which the each of yarns 23 from creel 13 are threaded.

A conventional beaming apparatus as described above typically operates at unwinding speeds of about 170 meters per minute, depending on the yarn. As will be explained in greater detail below, there are inherent problems with such conventional beaming apparatuses which are solved by the present invention.

SUMMARY OF THE INVENTION

The inventive apparatus includes the following features: a rotating guide, an elastomeric yarn unwinder assembly that includes a guide support that supports rotating guides and a movable buggy for transporting wound cakes of elastomeric yarn to the guide support, a metal thread guide, a front guide and tension bar assembly and a pivoting reed.

The inventive rotating guide for unwinding elastomeric yarn from a stationary cake of wound elastomeric yarn includes a disk, a connector portion formed in the disk to allow the disk to be connected to means for rotating the disk, an aperture formed in the surface of the disk between the connector portion and the outer edge of the disk to allow elastomeric yarn to pass therethrough as the disk is rotated and elastomeric yarn is unwound from the cake, and means in the aperture for controlling the pulling force on an elastomeric yarn pulled through the aperture so that if the elastomeric yarn is unwinding freely from the cake the pulling force is decreased and if the elastomeric yarn is not unwinding freely from the cake the pulling force is increased. In one embodiment the pulling force control means includes a top ring, middle ring and bottom ring stacked together in the aperture, each of the rings having an opening formed therein, the middle ring having a projection formed therein that extends into the opening thereof so as to partially cover the openings in the top and bottom rings and that extends in a direction away from the direction of rotation of the rotating guide, wherein the width of the middle ring around the perimeter of the opening formed therein is less than or equal to the width of the corresponding portions of the top and bottom rings.

The invention also relates to an elastomeric yarn unwinder assembly which includes a rotating guide having a disk, a connector portion formed in the disk to allow the disk to be connected to means for rotating the disk, and an aperture formed in the surface of the disk between the connector portion and the outer edge of the disk to allow elastomeric yarn to pass therethrough as the disk is rotated and elastomeric yarn is unwound from the cake, means for rotating the rotating guide attached to the connector portion, and a stationary cake of elastomeric yarn positioned adjacent to the rotating guide. The rotating guide of the unwinder assembly may also include means in the aperture as described above for controlling the pulling force on an elastomeric yarn pulled through the aperture so that if the elastomeric yarn is unwinding freely from the cake the pulling force is decreased and if the elastomeric yarn is not unwinding freely from the cake the pulling force is increased.

The elastomeric yarn unwinder assembly may also include a guide support having at least one arm extending outwardly therefrom, the means for rotating a rotating guide being attached to the arm so as to support the rotating means and the rotating guide on the guide support, and a tray supported on the guide support and positioned below the rotating guide so as to support a stationary cake of elastomeric yarn below the rotating guide. The assembly may also include a movable buggy adapted to mate to the guide support having at least one arm formed therein which extends outwardly therefrom, the stationary cake of elastomeric yarn being supported on the buggy arm such that when the buggy is mated to the guide support the stationary cake of elastomeric yarn is supported below the rotating guide.

Another feature of the invention is a thread guide assembly for use in a beaming apparatus which includes a thread guide having a top portion and a bottom portion, the top portion having a loop formed therein to hold a thread of yarn, a base member attached to the bottom portion of the thread guide so that the top portion of the thread guide may be moved under tension, and means in the base member for detecting an increase in tension on the thread guide so that the tension detecting means provides an indication if the tension on the thread guide exceeds a predetermined amount.

Still another feature of the invention is a thread guide for use in a beaming apparatus, which guide has a loop formed therein to hold a thread of yarn, wherein the thread guide includes a surface-hardened metal.

Another feature of the invention is a front guide and tension bar assembly for use in a beaming apparatus which includes a bar having a plurality of guides formed therein for allowing yarn to be threaded therethrough, and means connected to the bar for measuring the pressure on the bar caused by the force of yarn on the bar as yarn is pulled through the guides in the bar. The assembly may also include output means for receiving a signal from the pressure measuring means and providing a measurement of the pressure on the bar and pressure monitoring means for receiving a signal of the pressure from the output means, comparing the pressure to a range of desired pressure values, and sending a signal to an output means if the pressure on bar falls outside the range of desired pressure values.

The invention also relates to a method for unwinding a cake of wound yarn by unwinding the yarn in a creel according to a revolution control over end take off method, passing the yarn through a front guide, measuring the pressure on the front guide caused by the force of yarn on the front guide as yarn is pulled therethrough, and beaming the yarn onto a beam which is rotated in a warper head wherein the speed of rotation of the over end roll may be controlled based upon the pressure on the front guide on the bar.

Another feature of the invention is a reed for use in a beaming apparatus includes a bar having a plurality of needles formed therein, and means connected to the bar for pivoting the bar in at least a horizontal plane.

DETAILED DESCRIPTION

Figure 1:
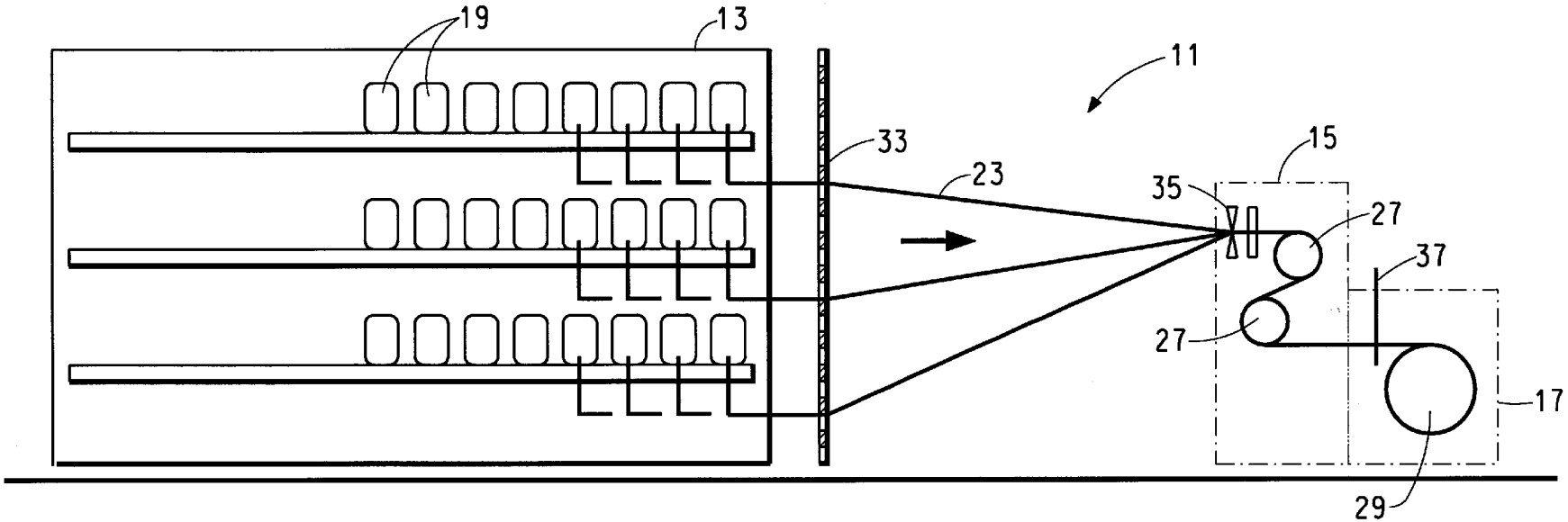
FIG. 1 (PRIOR ART)
FIG. 1 is a side view in elevation of a conventional prior art elastomeric yarn beaming apparatus.
Figure 2:
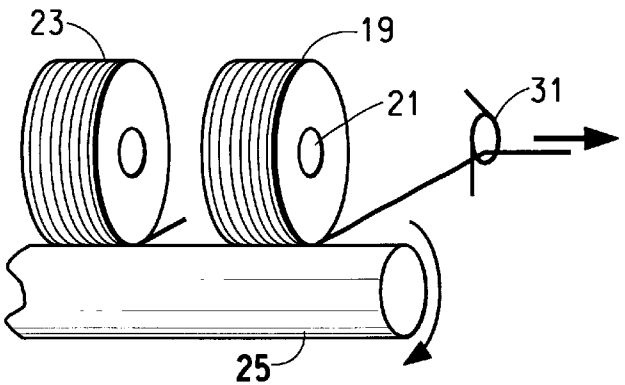
FIG. 2 (PRIOR ART)
FIG. 2 is a view in perspective of a surface driven take-off apparatus of the creel of the beaming apparatus as shown in FIG. 1.

The present invention relates to an apparatus for high speed beaming of elastomeric yarn. The apparatus includes a creel and a beam warper. The creel has a plurality of cakes, which are tubes having elastomeric yarn wound thereon, and yarn is unwound from the cakes in the creel and beamed, or warped onto a beam in the beam warper. This apparatus allows the unwound elastomeric yarn to be beamed at speeds three times the speed of conventional surface driven beaming apparatuses, up to about 600 meters per minute. As used herein, the term "elastomeric" is defined as a continuous filament which has a break elongation in excess of 100% and which when stretched and released, retracts quickly and forcibly to substantially its original length. Such fibers include, but are not necessarily limited to, rubber fiber, spandex, and polyetherester fiber, and may be covered with other, non-elastomeric fibers or may be bare (uncovered). The elastomeric yarn may be, for example, elastane or spandex yarn such as that sold by E. I. du Pont de Nemours and Company under its trademark Lycra®.

The beaming apparatus of the invention includes a creel for supporting wound cakes of elastomeric yarn, and a warper head where ends of unwound yarn are wound onto a large beam. The beaming apparatus is based on an over-end take-off method, that is, a method of unwinding elastomeric yarn from cakes which remain stationary during the beaming operation.

The inventive apparatus includes the following features: a rotating guide, an elastomeric yarn unwinder assembly that includes a guide support that supports rotating guides and a movable buggy for transporting wound cakes of elastomeric yarn to the guide support, a metal thread guide, a front guide and tension bar assembly and a pivoting reed. It should be noted that although the inventive apparatus may include all of the features listed above, it is not necessary that the apparatus include every feature. For example, it is possible to modify an existing conventional beaming apparatus to include one or two of the inventive features, such as, for example, only the thread guides or the front guide and tension bar assembly.

One aspect of the invention is a rotating guide for unwinding yarn from the stationary wound cakes of elastomeric yarn. The combination of a rotating guide and a stationary wound cake of elastomeric yarn is sometimes referred to herein as an elastomeric yarn unwinder assembly. The rotating guide includes a disk that is connected to means for rotating the disk and an aperture formed in the surface of the disk to allow yarn to pass therethrough as the yarn is unwound from the cake. The disk is rotated at high speed to unwind the yarn, with the speed of rotation of the disk being coordinated with the speed of rotation of the beam in the warper head onto which the yarn is wound.

An important aspect of the rotating guide is that the guide includes means for controlling the pulling force on the yarn so that if the yarn is unwinding freely from the cake the pulling force is decreased and if the yarn is not unwinding freely from the cake the pulling force is increased. These means greatly decrease the problems associated with unwinding elastomeric yarn using an over-end take-off method.

In another aspect of the invention, the elastomeric yarn unwinder assembly further includes a guide support which supports one or more rotating guides. The guide support has a plurality of arms that extend outwardly therefrom, and means for rotating a rotating guide are attached to the arms. A rotating guide is connected to each rotating means. The guide support further includes a tray positioned below the rotating guide to support stationary cakes of elastomeric yarn below each rotating guide.

Preferably the elastomeric yarn unwinder assembly includes a movable buggy adapted to mate to the guide support that supports wound cakes of elastomeric yarn. The buggy has a plurality of shelves formed therein which extend outwardly therefrom, and a tray is supported on the arms of the buggy such that when the buggy is mated to the guide support, stationary cakes of elastomeric yarn may be placed on a tray and supported below each rotating guide in a position that allows the cakes to be unwound by the guides. Preferably, the buggy is mounted on wheels.

The use of multiple movable buggies greatly increases the overall efficiency of the beaming process because it allows operators to conduct the time consuming process of preparing the cakes for the beaming operation separately from and concurrently with the beaming operation. When the cakes in an elastomeric yarn unwinder assembly have been unwound, the buggy with unwound cakes is disengaged and wheeled away from the guide support, and another buggy filled with wound cakes is moved into the creel and mated with the guide support to unwind the yarn from the wound cakes.

Another feature of the present invention is a thread guide through which unwound yarn is passed for orienting the unwound yarn towards the warper head. It has been discovered that just before a yarn breaks, the tension in the yarn increases, and therefore the thread guide of the invention includes means for monitoring the position of the thread guide so that if the guide moves beyond a desired range because of an increase in the tension in the yarn being passed therethrough, the monitoring means sends a signal which can alert an operator to a potential break in the yarn.

Further, thread guides are conventionally made from ceramic because the ceramic surface lasts a long time even when subjected to constant friction from the elastomeric yarn. However, it has been discovered that certain types of metals having improved wear characteristics, such as surface-hardened metals, may be used in these thread guides which results in guides that are cheaper and simpler than ceramic guides and which last comparatively as long as the ceramic guides.

Still another feature of the invention is a front guide and tension bar assembly positioned near the end of the creel for orienting and aligning the unwound yarn as the yarn leaves the creel and moves toward the warper head. The front guide and tension bar assembly includes a bar having guides formed therein for allowing yarn to be passed therethrough and means connected to the bar for measuring the pressure on the bar caused by the force of yarn on the bar as yarn is pulled through the guides in the bar. The assembly may also include pressure monitoring means for receiving a signal of the pressure from the pressure measuring means, comparing the pressure to a range of desired pressure values, and sending a signal to an output means if the pressure on the bar falls outside the range of desired values.

Further, the front guide and tension bar assembly allows the beaming process to be controlled by monitoring the pressure on the bar of the front guide and tension bar assembly, such as by monitoring a signal from the output means, which makes possible a heretofore unrealized improvement in the quality of the beaming operation. Further, the front guide and tension bar assembly adds no additional friction points in contrast to alternative solutions applied to conventional beaming machines.

Still another feature of the invention is a pivoting open reed for orienting the yarn onto the beam after the yarn leaves the front guide. The pivoting reed includes a bar, a plurality of needles on the bar, and means connected to the bar for pivoting the bar in at least a horizontal plane. The pivoting means may be a post and a hinge that connects the post to the bar and allows the bar to pivot around the post. When it is desired to change the width of the threadsheet being wound onto the beam, the reed is pivoted about the post to change to make the distance between adjacent ends greater or smaller.

Figure 3:
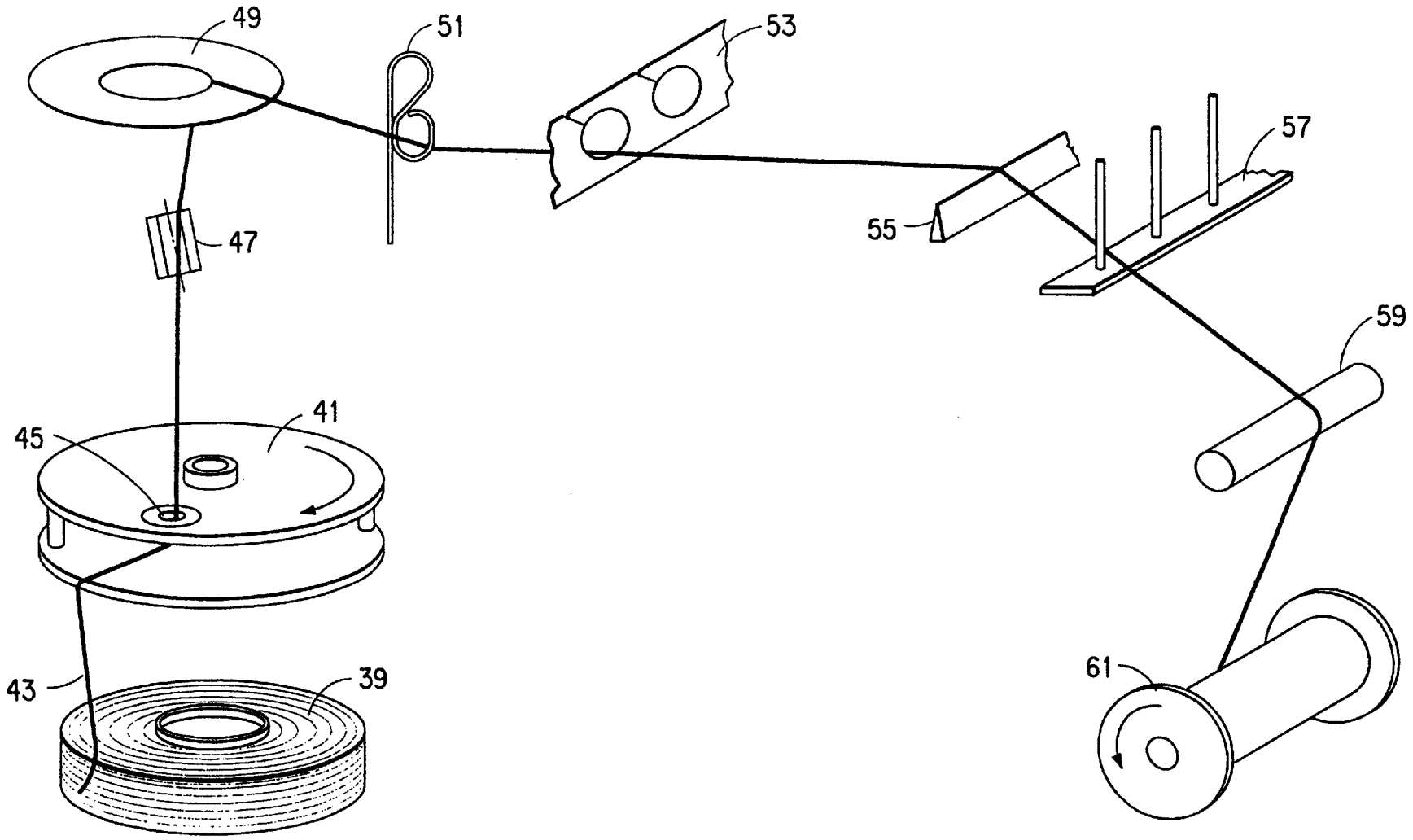
FIG. 3 is a view in perspective of features of the present invention illustrated as yarn moves from a cake to a beam.

FIG. 3 shows an exploded view of some of the features of the invention and how those features interact with an elastomeric yarn as the yarn moves from a cake to a beam.

Turning to FIG. 3 there is shown a stationary cake 39 of wound elastomeric yarn. A rotating guide 41 is positioned above cake 39 and an elastomeric yarn 43 is taken from cake 39 and treaded through pulling force control means 45 in guide 41. Guide 41 is rotated by a drive means (not shown) in the direction indicated by the arrow. Yarn 43 passes through a tube guide 47, over ring guide 49 and through thread guide 51. Thread guide 51 guides yarn 43 from rotating guide 41 and orients yarn 43 towards the beam warper of the apparatus. Thread guide 51 is made of a low friction material and includes means for stopping the beaming process before a break in the elastomeric yarn occurs. Yarn 43 next passes through a front guide and tension bar assembly 53 which has a yarn tension monitoring means to allow a controller to have trouble free operation during the critical phase of starting the beaming process and also allows the quality of the ongoing beaming operation to be maintained. Yarn 43 next passes over a support blade 55 and through reed 57 for aligning a plurality of yarns 43. Yarn 43 then passes over overrun roll 59 and onto beam 61.

Elastomeric Yarn Unwinder Assembly

Figure 4:
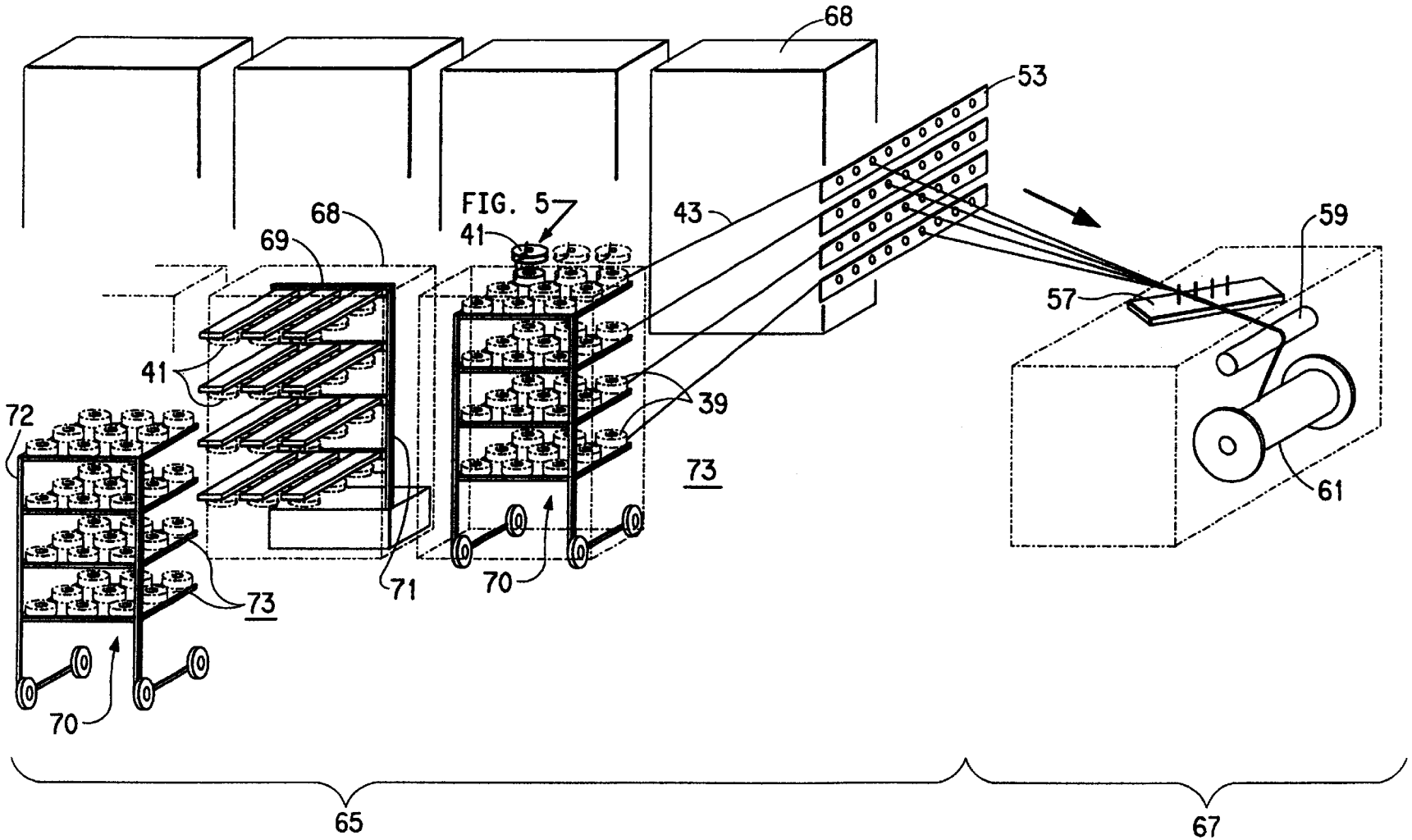
FIG. 4 is a view in perspective of a beaming apparatus constructed in accordance with this invention which shows an elastomeric yarn unwinder assembly that includes a guide support and a movable buggy.

FIG. 4 is a view in perspective of a beaming apparatus that includes the features shown in FIG. 3. Turning to FIG. 4 there is shown a beaming apparatus that comprises a creel 65 and a warper head 67. Creel 65 includes a plurality of elastomeric yarn unwinder assemblies 68 which include a guide support 69 and a movable buggy 70 that mates with guide support 69. Guide support 69 includes a frame 71 which supports a plurality of rotating guides 41. More specifically, frame 71 has a plurality of arms attached thereto that support guides 41. Movable buggy 70 has frame 72 that supports removable trays 73. More specifically, frame 72 has a plurality of shelves attached thereto that support trays 73. Cakes 39 are placed on trays 73, and trays 73 preferably should have upwardly extending protrusions formed therein that fit within the inner tubes of cake 39 to prevent cakes 39 from sliding on tray 73. Conventionally, cakes 39 are shipped to the location of the beaming apparatus on trays in boxes, and in a preferred embodiment, trays 73 are the same trays on which cakes 39 are shipped.

Guide support 69 and movable buggy 70 are adapted to mate together so that when mated, cakes 39 are positioned below rotating guides 41.

Yarn 43 is unwound from cakes 39 in creel 65 and passes through front guide 53 and on to warper head 67. Note that there is one front guide 53 for each of the four different levels of cakes 39 in creel 65. Further, if creel 65 exceeds a certain length it may be necessary to put front guides 59 at a point along the length of creel 65. However, the present invention is not limited to any particular number of front guides 53 per level of cakes 39 nor to any particular number of such levels.

The use of a movable buggy 70 in creel 65 marks a decided advance in the art and a dramatic increase in the output of the beaming apparatus. In the conventional beaming apparatus 11 shown in FIG. 1, the warping process comes to a halt when yarn 23 is completely unwound from cakes 19. At that point, all the empty tubes must be removed from machine 11 and replaced with new cakes 19. Since most beaming apparatuses 11 have 1000 to 1600 cakes 19, the removal of the empty tubes, installation of new cakes 19, and the tying of the ends of a new yarn 23 to the ends of an old yarn 23 already in machine 11 is a very time consuming process that reduces the productivity of the beaming operation.

Turning to FIG. 4, the advantage of buggy 70 is that it allows cakes 39 to be unpacked and loaded onto buggy 70 at the same time the beaming apparatus is operating. Once all cakes 39 on buggy 70 in creel 65 have been unwound, buggy 70 is rolled out of creel 65 and is replaced by buggy 70 that has been filled with new cakes 39. The buggy 70 full of new cakes 39 is then mated with guide support 69. It is also possible to replace empty trays 73 with full trays 73 without changing buggy 70.

Thus, the use of movable buggies 70 greatly reduces the down time of the beaming apparatus because there is no down time for removing old unwound cakes 39 and replacing them with new wound cakes 39. Once a buggy 70 with new cakes 39 has been put in place, the only thing that needs to be done is for the old ends of yarn 43 to be tied to the new ends of yarn 43 at some place in the beaming apparatus, preferably to an end of a thread of yarn 43 that hangs below rotating guide 41. This results in minimal downtime of the beaming apparatus, and thus increased beaming efficiency and increased output of wound beams.

Rotating Guide

One feature of the present invention is a rotating guide for unwinding elastomeric yarn from a stationary cake in a creel. Rotating guides are known for unwinding non-elastomeric yarns, but have heretofore not been used to unwind stationary cakes of elastomeric yarns. Such known rotating guides unwind yarn by rotating around the perimeter of a cake between the top and bottom of the yarn wound on the cake.

An inherent problem with unwinding elastomeric yarn that since it is elastomeric, the yarn stretches when it is pulled, and therefore it is difficult to control the mass flow of the yarn. For example, when 44 dtex elastane yarn is subject to tension the yarn may stretch up to five times its original length. Thus, conventional beaming processes for elastane have focused on surface-driven unwinding of cakes in which the surface of the elastane yarn on the cake is in contact with a roll which rotates against the circumferential surface of the cake to unwind the yarn from the cake.

There are many inherent disadvantages to the surface-driven unwinding of cakes of elastomeric yarn. First, there is a limitation on the speed at which the cakes may be unwound. Conventional beaming apparatuses which use rollers that contact the surface of the cakes to unwind the yarn from the cakes have unwinding speeds of less than about 200 meters per minute. Speeds higher than 200 meters per minute may be used, but result in a decline in the quality of the unwinding process. For example, at higher speeds the contact between the cake and the roller becomes unstable which results in poor unwinding quality. Also, when there is an abrupt stop from such higher speeds the contact surface of the cake may be damaged and trapped ends may be formed on the cake.

Another important disadvantage to the surface-driven unwinding of cakes is that the cakes must be of a similar size and shape to obtain a quality unwinding process. Cakes of elastomeric yarn are "alive" in the sense that as the cakes age they change shape. When elastomeric yarn is spun the yarn is wound directly on tubes to make the cakes. Over time, the top, bottom, and/or circumferential surface of the cake tends to change. If cakes of sufficiently different ages are used in a conventional creel, there are problems in operation caused by the variation in the surface contact of the various cakes on the drive rolls in the creel. One such problem is excessive vibration on the rollers. Thus, experience has shown that the best beaming operations occur when cakes of a similar age are used. Since beaming apparatuses usually use about 1000–1600 cakes, many cakes may be unusable in warping if there is less than the full complement of 1000–1600 cakes of the same age left in a batch.

Another problem in unwinding elastomeric yarn is excessive tackiness of the yarn. "Tackiness" is used to describe the resistance of the yarn to being unwound, and includes both tackiness caused by the chemical composition of the yarn and by mechanical overwrapping of the yarn on the tube. While some tackiness is always present with elastane, excessive tackiness causes problems that are fatal to a beaming operation because such excessive tackiness leads to backwrapping of the yarn onto the cake which continues until the yarn breaks.

Each time a yarn breaks in a beaming apparatus, the entire beaming process must be stopped. The operator must enter the creel and find which of the 1000–1600 ends has broken. Once the cake with the broken end has been found, the operator must obtain a new end from the cake and bring it towards the warper head. The operator must also find where the yarn was broken on the beam in the warper. Once the end on the beam has been located, the the two ends are tied together, and the beaming operation is restarted. It is therefore obvious that a beaming apparatus may be dramatically improved if such apparatus can be designed so as to cause fewer breaks in the yarn during the process of beaming.

Many of the problems inherent in the surface-driven unwinding operation in beaming may be overcome by designing an apparatus for unwinding cakes of elastomeric yarn using an over-end take-off method. The concept behind the over-end take-off method is that the yarn is removed from a cake while the cake is kept stationary. Such over-end take-off methods and apparatuses have been developed and used for "hard", that is, non-elastomeric yarns, but heretofore these methods and apparatuses have not been used for elastomeric yarns because of the problems resulting from the elastomeric nature of these yarns. The present invention relates in part to a rotating guide which may be used to unwind elastomeric yarns via an over-end take-off method. The invention further relates to an elastomeric yarn unwinder assembly including the rotating guide.

Figure 5:
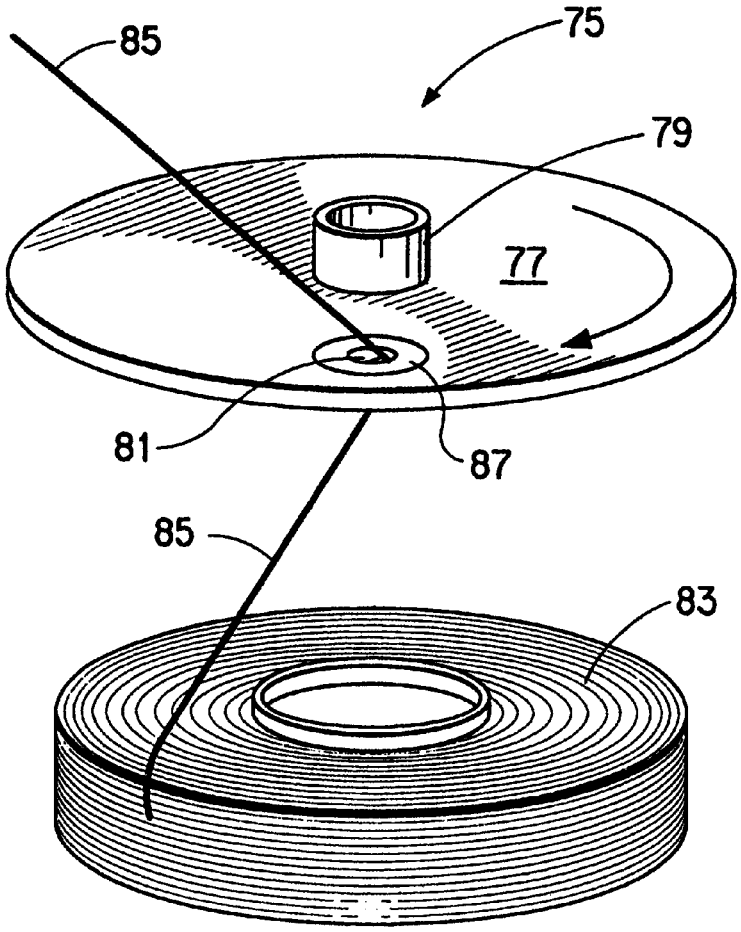
FIG. 5 is a view in perspective of and unwound cake of elastomeric yarn and one embodiment of a rotating guide used in the creel of FIG. 4.

An example of a rotating guide constructed in accordance with this invention is shown in FIG. 5. Turning to FIG. 5 there is shown a rotating guide 75 that includes a disk 77, a connector portion 79 formed in the center of disk 77 to allow guide 75 to be connected to means (not shown) for rotating guide 75, and an aperture 81 formed in disk 77 between connector portion 79 and the outer edge of disk 77.

Rotating guide 75 is positioned above a stationary cake 83 of elastomeric yarn so as to form a space therebetween. In operation, a strand of yarn 85 is passed through aperture 81 and connected to a warper head that exerts a pulling force on yarn 85 as yarn 85 is unwound from cake 83 by rotating guide 75.

At the same time, the rotating means rotates guide 75 in the direction shown in FIG. 5 to remove yarn 85 from stationary cake 83. Guide 75 unwinds yarn 85 at speeds up to 600 meters per minute.

A problem with unwinding elastomeric yarn is backwrapping, which occurs when the yarn is so tacky that it does not unwind as a rotating guide rotates around a cake but instead starts to wrap back onto the cake. When this happens the tension in the yarn increases very quickly and causes the yarn to break.

Rotating guide 75 avoids the problem of incidental backwrapping because if there is a tacky spot in yarn 85 on cake 83, instead of backwrapping on cake 83 yarn 85 will pass between disk 77 and cake 83 without further unwinding from cake 83 until the pulling tension on yarn 85 becomes sufficiently high to break yarn 85 free from the tacky spot.

Another potential problem with unwinding elastomeric yarn is that which may occur if one or more layers of yarn 85 near the top of cake 83 are loose. These layers, called "looses" in the art may cause yarn 85 to become tangled. This tangling of yarn 85 is especially likely to happen when yarn 85 is unwound using an over-end take-off method because with this method yarn 85 is pulled above cake 83. If the direction of the pulling force on yarn 85 is near the core or tube of cake 83, looses are more likely to occur because there is a greater likelihood that as yarn 85 is pulled toward the center of cake 83 it will cause some of the top layers of yarn 85 to be undesirably pulled loose. If the direction of the pulling force is outside of the diameter of cake 83, there is less of a likelihood that looses will occur because yarn 85 will be pulled away from the circumference of cake 83 and therefore yarn 85 is less likely to contact the top layers of yarn 85 on cake 83. Once looses occur, yarn 85 is likely to get tangled and break because rotating guide 75 is not rotating fast enough to make yarn 85 taut.

The problem of looses, as well as the problem of excess friction, may be controlled by the position of aperture 81 on disk 77. The closer aperture 81 is to the edge of disk 77 the less likely it is that looses will occur because in that case yarn 85 is being pulled more outwardly than inwardly across the remaining yarn on cake 83. However, an increase in friction becomes more of a problem proportionate to the angle of encirclement on disk 77. Similarly, the closer aperture 81 is to connector portion 79 the less likely there will be an undesirable increase in friction proportionate to the angle of encirclement on disk 77, while at the same time looses are more likely to occur. Thus, the location of aperture 81 on disk 77 is a compromise between overcoming the problem of excess friction and the problem of looses.

When unwound at the high speeds provided by this invention, however, the takeoff of yarn 85 can become uncontrolled. This means that when yarn 85 is not tacky, yarn 85 will want to come off cake 83 too quickly in response to the pulling force from the warper head. When the yarn is tacky, increased tension needs to be applied to yarn 85 to allow yarn 85 to be pulled free from the tacky spot.

In order to control the takeoff of yarn 85 at high speeds, rotating guide 75 further includes means for controlling the pulling force so that if yarn 85 is unwinding freely from cake 83 the pulling force is decreased and if yarn 85 is not unwinding freely from the cake 83 the pulling force is increased.

Figure 6:
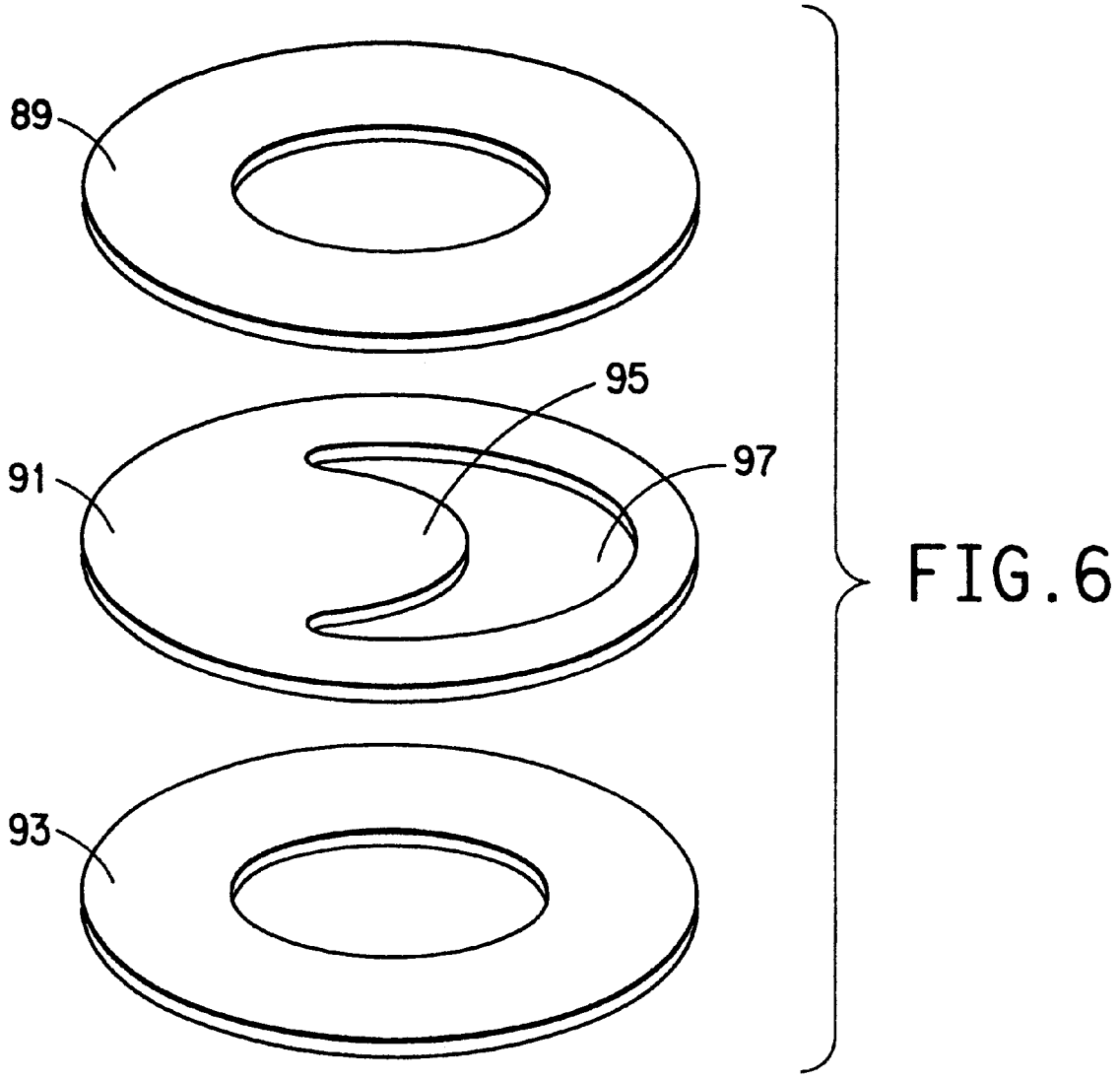
FIG. 6 is an exploded view in perspective of the pulling force control means of the rotating guide of FIG. 5.

One example of such pulling force control means is inserted in aperture 81 as shown in FIGS. 5–10. As shown in FIGS. 5–9, pulling force control means 87 is an insert that includes three metal rings positioned in aperture 81: top annular ring 89, middle ring 91 and bottom annular ring 93 as shown in FIG. 6.

Top ring 89 and bottom ring 93 have substantially the same diameter and annular width and have circular openings formed therein. Middle ring 91 has peninsula portion 95 formed therein which extends inwardly toward the center of ring 91 to make the opening 97 in ring 91 approximately C-shaped. Further, the width of the annular portion of ring 91 around the perimeter of opening 97 is less than the width of rings 89, 93.

Figure 7:
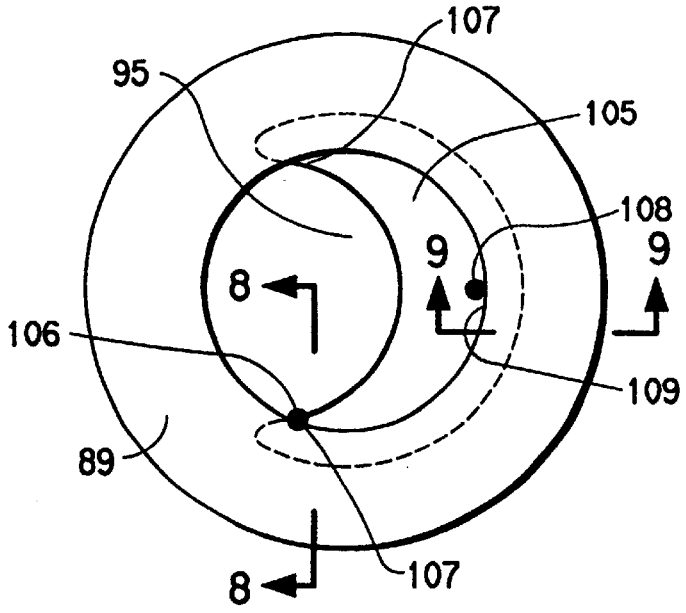
FIG. 7 is a top plan view of the pulling force control means of the rotating guide of FIG. 5.
Figure 8:
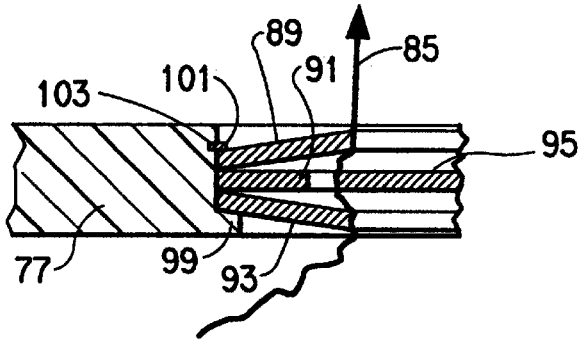
FIG. 8 is a view in partial cross section of the pulling force control means of FIG. 7 taken along the lines 8—8 in FIG. 7 and showing yarn being pulled through the means.
Figure 9:
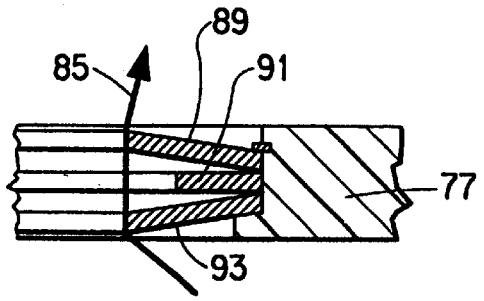
FIG. 9 is a view in partial cross section of the pulling force control means of FIG. 7 taken along lines 9—9 in FIG. 7 and showing yarn being pulled through the means.

FIGS. 7–9 show that in use, rings 89, 91, 93 are stacked one upon the other in aperture 81. Rings 89, 91, 93 are held in place in aperture 81 by a lip 99 formed in disk 77 near the bottom of aperture 81 and a ring clamp 101 that fits into a slot 103 formed in disk 77 near the top of aperture 81.

As shown in FIGS. 8 and 9, top ring 89 and bottom ring 93 are frustoconical, but middle ring 91 is flat, so that when stacked together, rings 89, 91, 93 are spaced apart near the openings in the rings 89, 91, 93.

As may be seen in FIG. 7, when rings 89, 91, 93 are stacked one upon the other, part of opening 97 in middle ring 91 is covered by top ring 89 and bottom ring 93 because the annular width of rings 89, 93 is greater than the width of the annular portion ring 91 around the perimeter of opening 97. Thus, when rings 89, 91, 93 are stacked together to form pulling force control means 87, there is formed a crescent shaped opening 105 have corners 107 and central portion 109.

Means 87 is positioned in disk 77 so that as disk 77 rotates, the corners 107 of opening 105 point in the direction of rotation. When yarn is fed through aperture 81 and rotating guide 75 is rotated in the direction shown in FIG. 5, means 87 automatically increases the pulling force on yarn 85 if yarn 85 is not unwinding freely from cake 83, and decreases the pulling force on yarn 85 if yarn 85 is unwinding freely from the cake 83. This phenomenon is explained with reference to FIGS. 7, 8 and 9.

FIGS. 7 and 8 show the scenario when yarn 85 is unwinding freely from cake 83 so that the point of contact between the yarn and the cake is "ahead" of aperture 81 in the rotating guide. In this case, yarn 85 moves to either of the two corners 107 of opening 105, which are the high friction points of means 87. In FIG. 7, yarn 85 is shown in cross-section as a filled circle 106 at corner 107. Corners 107 are high friction points because yarn 85 must undergo three changes of direction as it passes through means 87. Yarn 85 first changes direction upon entering means 87 by contacting and sliding over bottom ring 93. Yarn 85 then changes direction, or angle, when yarn 85 passes over peninsula portion 95 of middle disk 93. Yarn 85 changes direction for the third time as it passes over top disk 89.

It may be appreciated that the frusto-conical shape of top ring 89 and bottom ring 93 is important to the operation of pulling force control means 87 when yarn 85 is at corner 107 of opening 105. Yarn 85 may have small knots formed therein, as, for example, when an operator ties two ends of yarn 85 together, and if rings 89 and 93 were not spaced apart from middle ring 91 the knots in yarn 85 could get caught between rings 89, 91, 93 as the knot passed over peninsula 95, causing yarn 85 to break or to filament. By "filament" is meant that the yarn separates into several individual strands. Of course, means 87 may be constructed in other ways so that rings 89, 91, 93 are spaced apart. For example, top ring 89 and/or bottom ring 93 may be flat, and a spacer such as another ring may be placed between top ring 89 and middle ring 91 or between bottom ring 93 and middle ring 91.

When yarn 85 is at the high friction point of means 87, the pulling force on yarn 85 is braked, or reduced, to slow the speed of removal of yarn 85 from cake 83 until aperture 81 can "catch up" to the point of contact between the yarn and the cake.

FIGS. 7 and 9 show the scenario when yarn 85 is not unwinding freely from cake 83, such as when there is a tacky point on cake 83. In this case, yarn 85 moves to central portion 109 of opening 105, which is the low friction point of means 87. In FIG. 7, yarn 85 is shown in cross-section as a filled circle 108 at central portion 109. The friction on yarn 85 depends primarily on the sum of the angle of encirclement of yarn 85 as it moves from cake 83 and out of means 87. In FIG. 9, yarn 85 is at a low friction point because there is a minimal angle of encirclement of yarn 85 as it passes through means 87. Yarn 85 changes direction once when in contact with bottom ring 93 and then changes direction again slightly when in contact with top ring 89. Note that in this position, yarn 85 does not contact middle disk 91.

When yarn 85 is at the low friction point of means 87, the pulling force on yarn 85 between cake 83 and disk 77 is increased because the full pulling force from the overrun roll 59 is passed through means 87 to cake 83 to help yarn 85 break free from its tacky point on cake 83. Guide 75 may inadvertently make one or more full revolutions with yarn 85 at central portion 109 without yarn 85 being removed from cake 83. The pulling force on yarn 85 continues to increase until it breaks free from its tacky point.

The self-adjusting and graduated tension provided by means 87 results in better unwinding performance of the cakes.

While one embodiment of rings 89, 91, 93 has been shown, there is no specific limitation on their shape provided that when 85 yarn is unwinding freely from cake 83, yarn 85 undergoes more friction as yarn 85 passes through means 87 than when yarn 85 is not unwinding freely from cake 83.

It should be emphasized that pulling force control means 87 may have other embodiments provided that the pulling force on yarn 85 is braked or reduced when yarn 85 is unwinding freely from cake 83, and that the pulling force is increased on yarn 85 when yarn 85 is not unwinding freely from cake 83.

Figure 10:
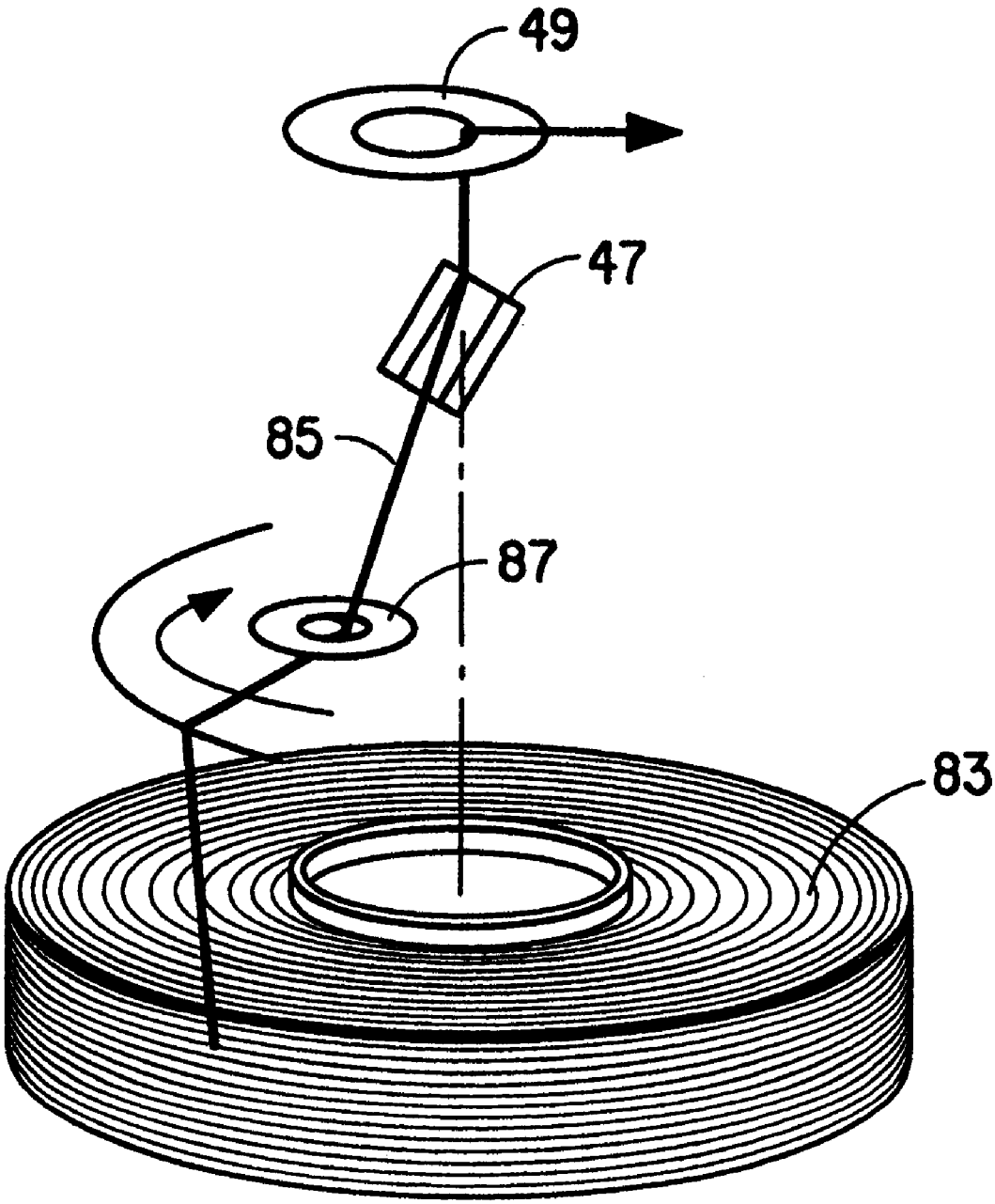
FIG. 10 is a view in perspective of a cake of elastomeric yarn which shows selected elements of the present invention as yarn is unwound from a cake and moves towards a thread guide.

FIG. 10 shows the relative position of pulling force control means 87, tube guide 47 and ring guide 49. Tube guide 47 is formed as part of the drive means for the rotating guide of the invention. For example, the drive means will typically be a motor placed above rotating guide 75 and connected to guide 75 by connector means 79 shown in FIG. 5. In this case, tube guide 47 is formed as part of, or is attached to, the shaft of the motor. The motor shaft is preferably hollow, so that yarn 85 passes through tube guide 47, up through the shaft of the motor, out of the motor, and then through ring guide 49. Thus, tube guide 47 rotates with rotating guide 75. Ring guide 49 changes the direction of yarn 85 and directs yarn 85 towards thread guide 51.

As described above, one potential problem with guide 75 may occur if one or more layers of yarn 85 near the top of cake 83 are pulled loose by yarn 85 as it is pulled from cake 83.

Figure 11:
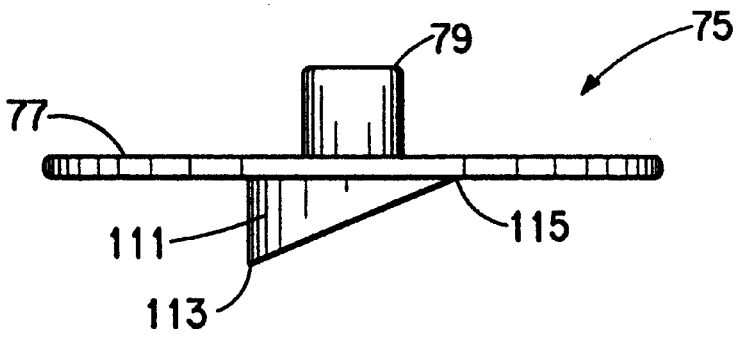
FIG. 11 is a side view in elevation of the rotating guide of FIG. 5.
Figure 12:
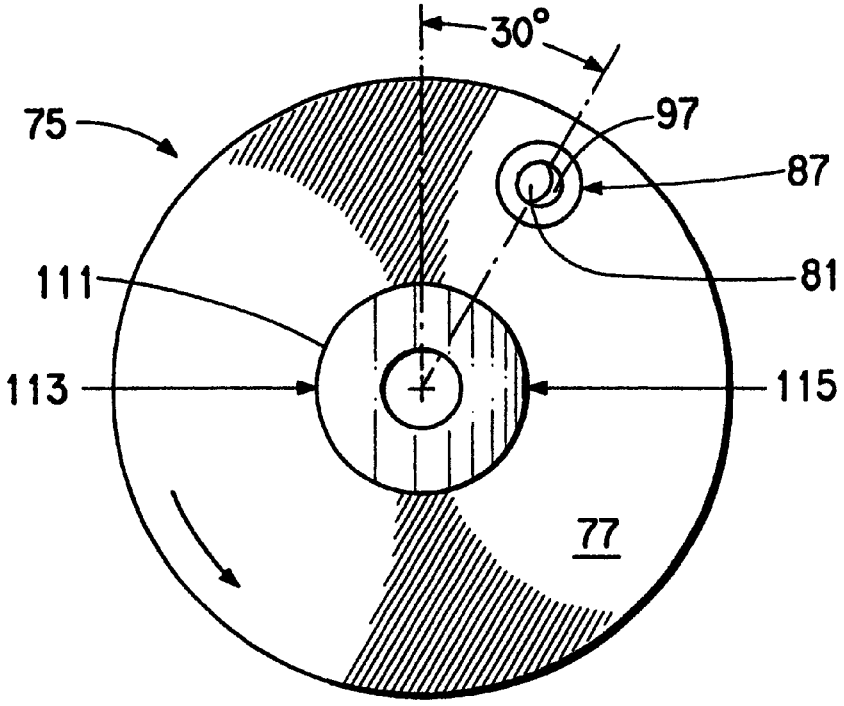
FIG. 12 is a bottom plan view of the rotating guide of FIG. 5.

One way to overcome the problem of looses is to provide a friction increasing means on disk 75 which increases the friction on yarn 85 to slow the speed at which it comes off cake 85 until rotating guide 75 catches up with yarn 85. One such means is shown in FIGS. 11–12 and includes a cylinder 111 formed on the bottom surface of disk 77. The purpose of cylinder 111 is to allow the pulling force on yarn 85 to continue to decrease so that the looses stop forming and disappear. In operation, once looses occur from the pulling force on yarn 85, yarn 85 starts to wrap around cylinder 111 and yarn 85 is not pulled directly from cake 83. At this point, the looses stop occurring because the pulling force from the warper head is pulling yarn 85 that is wrapped around cylinder 111. Yarn 85 continues to unwrap from cylinder 111 until guide 75 has caught up with all yarn 85 from the looses, at which point guide 75 again unwinds yarn 85 directly from cake 83.

One potential problem with cylinder 111 is if a sticker occurs. A sticker refers to a tacky point where yarn 85 sticks to cake 83. If a sticker occurs, yarn 85 will backwrap on cylinder 111 and the continued pulling force from the warper head will cause yarn 85 to break.

Accordingly, in a preferred embodiment, cylinder 111 has a beveled rim so as to give cylinder 111 a raised side 113 and a lowered side 115. In this case, when a sticker occurs yarn 85 passes over lowered side 115 of cylinder 111 which results in avoiding backwrapping and an increase in the pulling force applied to yarn 85 until yarn 85 breaks free from the sticky point on cake 83.

If cylinder 111 is beveled as shown in FIG. 11, then as shown in FIG. 12, pulling force control means 87 is preferably positioned approximately 30° from an imaginary line passing through the center of cylinder 111 at an angular position midway between raised side 113 and lowered side 115.

Figure 13:
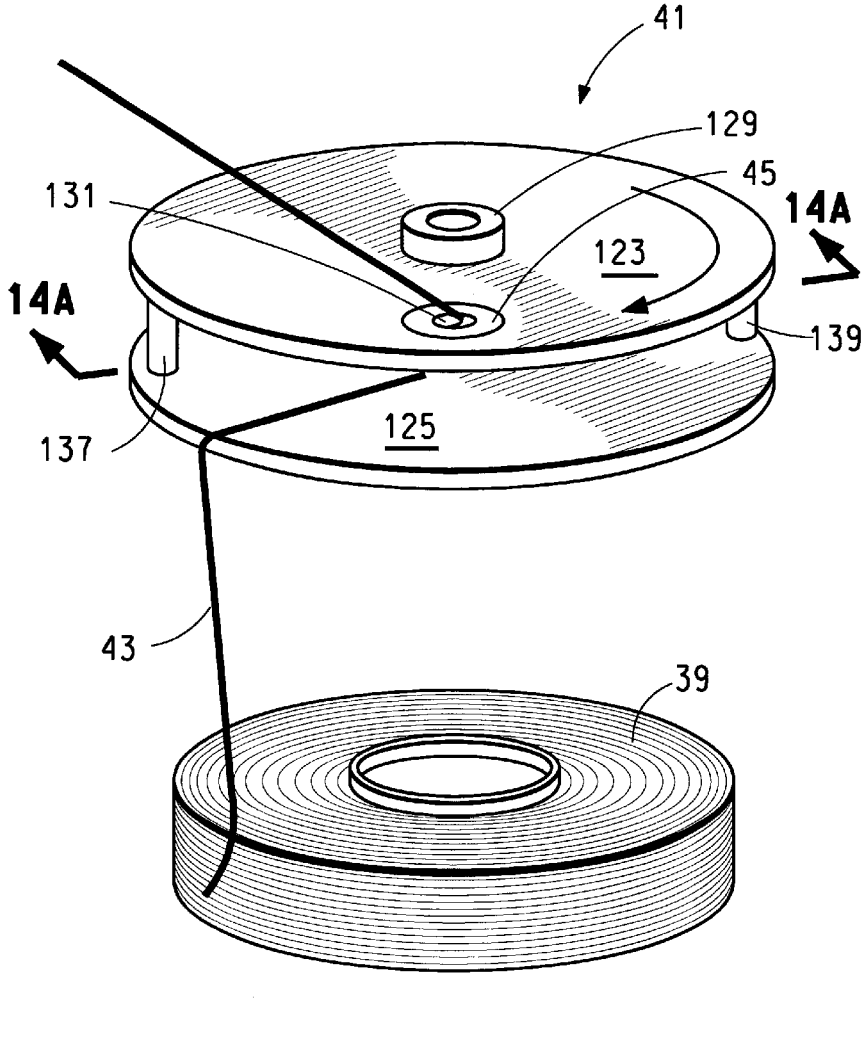
FIG. 13 is a view in perspective of another embodiment of the rotating guide of the present invention.
Figure 14A:
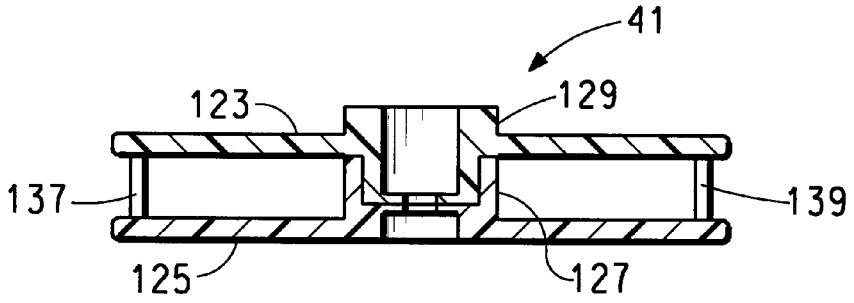
FIG. 14A is a side view in cross section of the rotating guide of FIG. 13.
Figure 14B:
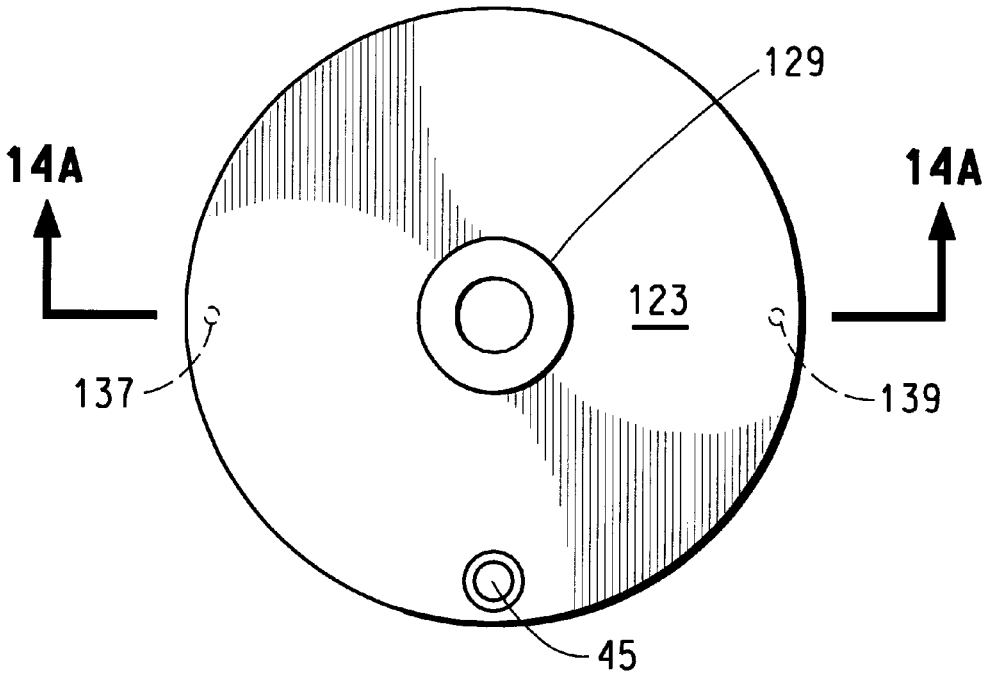
FIG. 14B is a top plan view of the rotating guide of FIG. 13.

FIGS. 13, 14A and 14B show another embodiment of the rotating guide of the invention which is similar to rotating guide 75 described above but includes a second disk.

Turning now to FIGS. 13, 14A and 14B , there is shown a rotating guide 41 that includes a top disk 123 and a bottom disk 125, a first connector portion 127 that connects top disk 123 and bottom disk 125, a second connector portion 129 formed in the center of top disk 123 to allow guide 41 to be connected to means (not shown) for rotating guide 41, and an aperture 131 formed in top disk 123 between second connector portion 129 and the outer edge of top disk 123.

Rotating guide 41 is positioned above a stationary cake 39 of elastomeric yarn 43 so as to form a space therebetween. Means 45 for controlling the pulling force on yarn 43 are formed in aperture 131 exactly as described above and as shown in FIGS. 5–9. In operation, yarn 43 is passed over the outside edge of bottom disk 125 through aperture 131 and connected to a warper head that exerts a pulling force on yarn 43 as yarn 43 is unwound from cake 39 by rotating guide 41.

An important purpose of bottom disk 125 is that it retards yarn 43 from going underneath guide 41 near the center of cake 39 when yarn 43 is unwinding freely from cake 39. Without bottom disk 125, freely unwinding yarn 43 would go underneath and to the center of guide 41 and possibly become entangled. With rotating guide 41 as shown in FIG. 13, yarn 43 does not get closer to the center of the bottom of guide 41 than the outside edge of bottom disk 125.

If the unwinding of yarn 43 from cake 39 becomes uncontrolled, yarn 43 may wrap around first connector portion 127, which is undesirable because it may cause yarn 43 to break. Accordingly, in a preferred embodiment, guide 41 further includes a front tube 137 attached to top disk 123 and bottom disk 125 and positioned between disks 123, 125 in front of aperture 131. A rear tube 139 may be similarly be attached to top disk 123 and bottom disk 125 and positioned between disks 123, 125 behind aperture 131. Here, "front" and "rear" refer to positions located before or after the arrival of aperture 45 at a given position when disk 41 is rotating. Tubes 137 and 139 may be cylindrical or conical. Front tube 137 prevents yarn 43 from becoming wrapped around first connector 127 when yarn 43 is under high tension, and rear tube 139 prevents yarn 43 from becoming wrapped around first connector 127 when yarn 139 is under low tension. Further, front tube 137 may be covered or coated with material that increases the friction of its surfaces so as to further aid the pulling force control means 45 in decreasing the pulling force on yarn 43 when it is unwinding freely from cake 39. Rear tube 139 may also be covered or coated with a material to balance the weight of guide 41.

Figure 15:
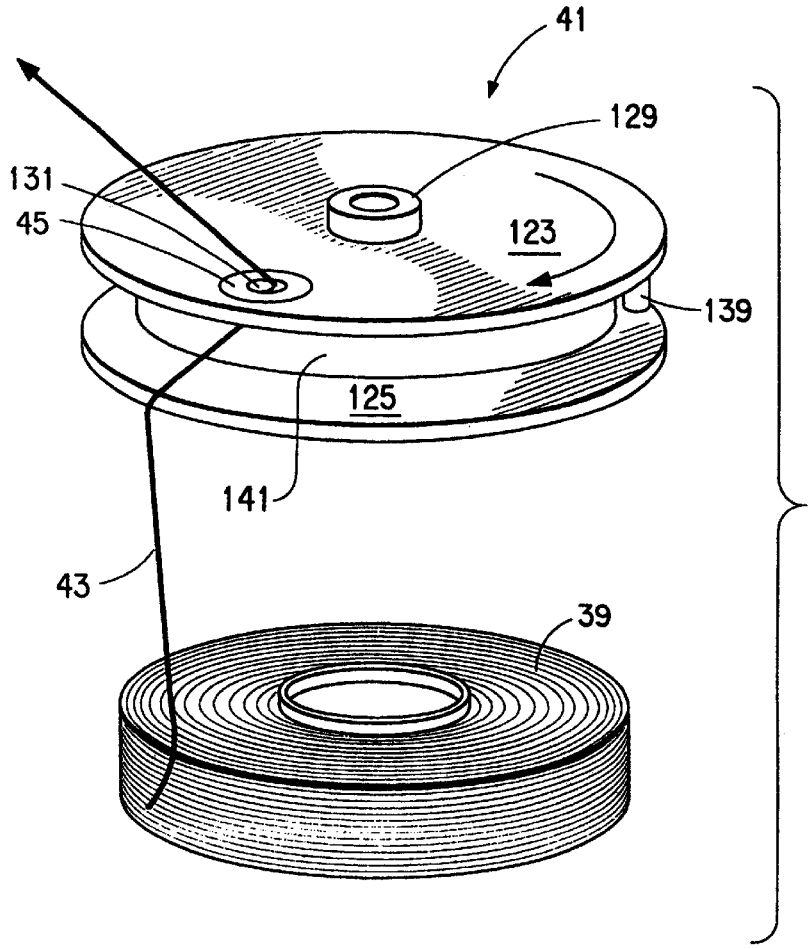
FIG. 15 is a view in perspective of another embodiment of the rotating guide of the present invention.

FIG. 15 shows another embodiment of the rotating guide which is similar to rotating guide 41 in FIGS. 13, 14A and 14B except that guide 41 has a cylindrical wall placed between the top and bottom disks.

Turning to FIG. 15, there is shown a rotating guide 41 having top disk 123 and bottom disk 125 spaced apart by a cylindrical wall 141. Guide 41 includes rear tube 139, but does not include a front tube. Rather, cylindrical wall 141 performs the same function as that performed by front tube 137 shown in FIG. 13. When yarn 43 is unwinding from cake 39 too freely, yarn 43 contacts and wraps around cylindrical wall 141 which increases the friction on yarn 43 to further aid pulling force control means 45 in decreasing the pulling force on yarn 43.

Wall 141 is spaced apart from the center of guide 41 but extends no further towards the outer edge of top disk 123 than the inner edge of aperture 131.

Rear tube 139 causes yarn 43 to fall beneath guide 41 to form a loose if there is too much tension on yarn 43, and prevents backwrapping of yarn 43 between top disk 123 and bottom disk 125 when the tension is too low. The position of rear tube 139 in guide 41 with respect to pulling force control means 45 is the same as is shown in FIG. 14B.

The rotating guide of the present invention thus provides an effective and practical method for unwinding elastomeric yarn by an over-end-takeoff method. As mentioned above, the rotating guide of the present invention allows cakes of different ages to be unwound at the same time without a decrease in quality of the warped yarn on the bobbin. As a result, small lots of cakes that would otherwise be unusable in a large warping operation may be rescued and used in a creel that has the rotating guide of this invention.

Thread Guides

Another aspect of the present invention relates to thread guides. In any conventional beaming apparatus, when elastomeric yarn has been unwound from a cake, the yarn from a plurality of cakes is directed toward the middle of a creel, and then all those yarns are redirected between about 70 to 90 degrees by being passed through a thread guide or a thread roll which orients the yarn from the creel towards the warper head.

In conventional beaming machines, such as those made by Liba Maschinenfabrik GmbH, the thread guides are made of ceramic because the ceramic is very resistant to potential wear caused by the yarn. The ceramic thread guides are usually made such that the yarn passes through the top end of the guide.

The ceramic thread guide has a metal contact point on the bottom end of the guide, and the guide is pivotally mounted on a creel. An electrical contact is positioned on the creel such that when there is no tension on the ceramic thread guide, the metal contact point of the guide touches the electrical contact on the creel.

In operation, when thread is being unwound from a cake there is tension on the yarn such that the ceramic thread guide is pivoted so that it does not contact the metal contact point on the creel. When a break occurs in the yarn, there is no longer tension on the ceramic thread guide and the guide contacts the electrical contact on the creel which sends a signal to a central control unit. At this point, the beaming apparatus comes to a complete stop, and an operator must enter the creel, find the end of the broken yarn, and tie the end of the broken yarn to the end of the yarn on the cake. This is a time consuming process that greatly reduces the productivity of the beaming apparatus. Further, when the beaming apparatus using the high speed rotating guides as described above is used, the end of the broken yarn may be more difficult to find because it may have become wrapped around the beam on the warper head.

One aspect of the present invention relates to an improved thread guide and a thread guide assembly for use in a beaming apparatus. Just before a yarn that is being unwound in a beaming apparatus breaks, the tension in the yarn increases. The increase in tension in the yarn may be caused, for example, by a series of tacky points in the yarn on the cake. Therefore, the thread guide assembly of the invention includes means for detecting an increase in tension in the yarn and for stopping the beaming process when such increase in tension occurs and before the yarn breaks.

Figure 16:
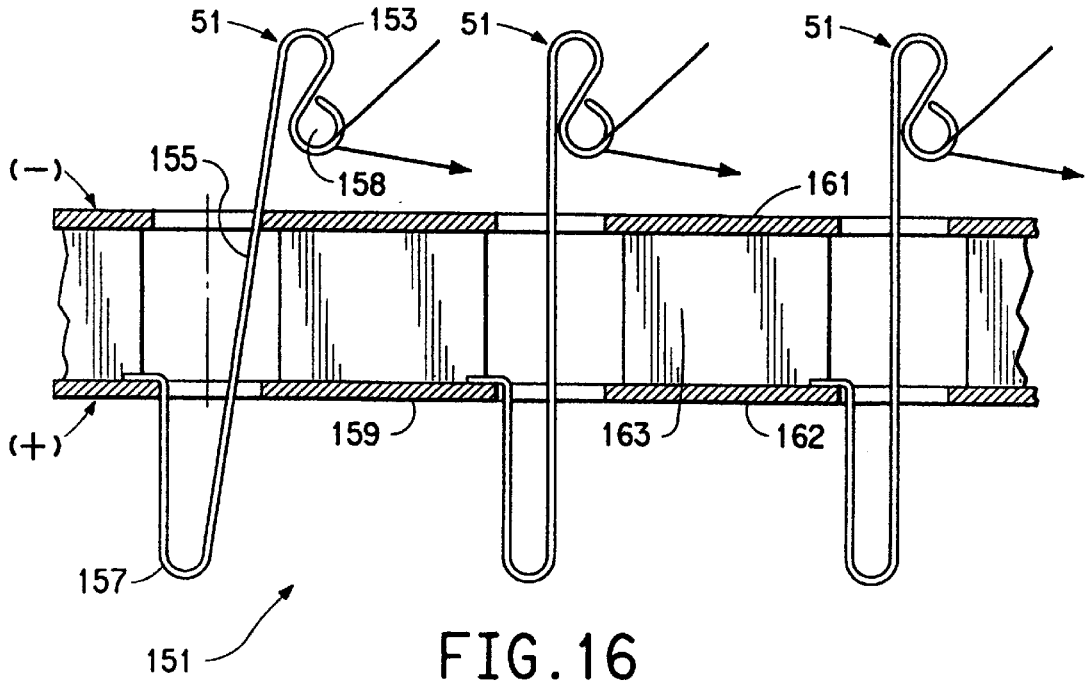
FIG. 16 is a side view in elevation of a thread guide assembly of the invention.

Turning to FIG. 16, there is shown a thread guide assembly 151 comprising a thread guide 51 and a base 159. Thread guide 51 has a top section 153, a middle section 155 and a bottom section 157, with top section 153 being curled so as to allow easy threading of elastomeric yarn through opening 158. Bottom section 157 of thread guide 51 has at least one bend formed therein similar to a hairpin and is secured in base 159 so as to counterbalance the tension on guide 51 caused by a yarn pulled through opening 158 and to allow top section 153 and middle section 155 of guide 51 to move under tension.

Thread guide assembly 151 also includes means for detecting an increase in tension in the yarn that passes through guide 51. One embodiment for the detection means is shown in FIG. 16 where base 159 includes an upper electrically conductive layer 161 and a lower electrically conductive layer 162 separated by an insulating layer 163. In this embodiment, at least those portions of guide 51 that would normally come in contact with layers 161, 162 are electrically conductive.

In operation, yarn is pulled from a cake, through thread guide 51 by a warper head, and wound onto a beam. Thread guide assembly 151 is oriented such that if there is such an undesirable increase in tension in the yarn, the yarn pulls top section 153 of guide 51 to the right which causes middle section 155 to contact both layers 161 and 162, which completes a circuit that sends a signal to a control device that causes the entire beaming process to stop running before the yarn breaks. This condition is shown in guide 51 on the left side of FIG. 16. The signal may be sent to an output device, either directly or through the control device, to indicate to an operator in which of the layers of yarns being unwound the tension build up has occurred. In this case, the operator may then solve the tension problem quickly and easily, such as by freeing the yarn from its tacky point, without having to locate the broken thread in the creel or another part of the beaming apparatus. Breaks in a yarn may occur even when using thread guide assembly 151, but such breaks are relatively infrequent and when such breaks occur they are detected much earlier than in conventional beaming machines.

The thread guide assembly may also include means for indicating that no yarn is present in the assembly, such as when a yarn has been broken. In one embodiment, thread guide 51 may have three distinct positions in thread guide assembly 151 corresponding to three conditions: (1) when no yarn is present in thread guide 51, (2) when yarn is present in thread guide 51 and the beaming operation is running under normal conditions and (3) when yarn is present in thread guide 51 but there is an undesirable amount of tension on thread guide 51. Thread guide assembly 151 shown in FIG. 16 is capable of indicating conditions (1) and (2), but may also be made to indicate condition (3). For example thread guide 51 and contact 162 may be constructed such that when no yarn is present therein thread guide 51 contacts both electrically conductive collar 161 and an electrically conductive contact 162 to complete a circuit and send a signal to a control device or an output device to indicate that no yarn is present in guide 51.

The means for detecting an increase in tension in the yarn that passes through guide 51 is not limited to any one particular means, but rather may be any convenient electrical or optical mechanism for detecting a change in the position of guide 51. For example, the thread guide assembly may include an optical sensor that senses the position of guide 51. The sensor may be calibrated so that a first amount of movement of guide 51 sends a signal to a control device or a display device to provide an alarm of a possible break in a yarn passing through guide 51, and that a second amount of movement of guide 51 sends a signal to a control device or a display device to provide an alarm of an actual break in a yarn.

Thread guide assembly 151 is particularly beneficial when used in a beaming apparatus that includes the other features of this invention because it is more sensitive to breaks in the yarn at the high beaming speeds contemplated by the present invention. The higher the beaming speed, the less time there is to stop a break in sufficient time for an operator to locate the end of the broken yarn before it begins to wrap around the beam in the warper head.

The sensitivity of guide 51 to changes in tension is controlled by the length of guide 51, and especially the length of section 155. It is the length of section 155 that provides the resistance to guide 51 moving in response to a build up of tension in the yarn. The tension the yarn is under, and the tension at which the yarn will break, depends on the dtex of the yarn, and therefore the length of section 155 to be used is determined based upon the dtex of the yarn to be unwound. Preferably, guide 51 is mechanically adjustable, such as along section 155, so that the working length of guide 51 and thus the sensitivity thereof to changes in tension, may be varied as necessary depending on the yarn being unwound.

For example, an elastomeric yarn of 44 dtex is under a tension of about 4 cN under a normal beaming operation, and will usually break when put under a tension of about 35 cN. Therefore, the length of guide 51 and section 155 is selected so that guide 51 contacts the tension increase detecting means when the guide is under a tension of about 20–30 cN, to give a warning that a break in the yarn may be about to occur.

The thickness of thread guide 51 is also important, and is selected based upon the thickness of the yarn that passes through guide 51 to minimize the friction on the yarn. For an elastomeric yarn of 44 dtex, a preferred radius of guide 51 is 0.3 mm, which corresponds to a diameter of 0.6 mm.

Based upon a yarn of 44 dtex, thread guide 51 has a much smaller diameter than conventional ceramic guides, which for the same yarn would have a diameter of about 2–3 mm. The smaller diameter of guide 51 is advantageous because the passage angle of the yarn on guide 51 may be modified with virtually no change in friction on guide 51. Since ceramic guides are by their very nature relatively thick, the surface of the ceramic guide that contacts the yarn has to be sharply sloped in order to get an optimal low friction contact point, and changing the angle of an elastomeric yarn through the guide can therefore greatly increase the portion of the surface of the ceramic guide that the elastomeric yarn contacts.

In a second aspect of the invention, the thread guide is made of a hardened metal. Metal has not heretofore been used for thread guides in a beaming apparatus because metal surfaces tend to wear out quickly from the constant friction caused by beaming elastomeric yarn.

However, it has been discovered that certain hardened metals are suitable for use as a guide element. Examples of suitable metals include austenitic stainless steels, such as 304 and 316 austenitic stainless steels. Further examples of austenitic stainless steels having acceptable hardness are austenitic stainless steels having a surface hardness of between 1,000 and 1,200 Vickers Hardness. A preferred type of austenitic stainless steel is one that is ferrite free and that contains molybdenum since such stainless steel has a greatly increased resistance to pitting, crevices and stress corrosion.

In addition, surface-hardened metals such as surface-hardened stainless steel or metals coated with a diamond-like carbon coating or titannitride may be used. Such surface-hardened metals have hardnesses of from about 1000 up to about 3000 Vickers Hardness.

One method by which the stainless steel may be hardened is a process known as Kolsterizing, a process for hardening steel practiced by Hardiff B. V. of Apeldoorn, the Netherlands, which eliminates galling problems of the stainless steel without change in shape, size and/or color of the stainless steel.

Front Guides and Tension Bar

As mentioned above, after yarn from each cake is unwound and redirected by the thread guides, the yarn from each group of cakes on the same level of a creel frame passes through a front guide. The purpose of the front guide in a conventional beaming apparatus is to maintain good separation between the yarn threads and to direct the sheet of threads from a particular level of the creel.

Figure 17:
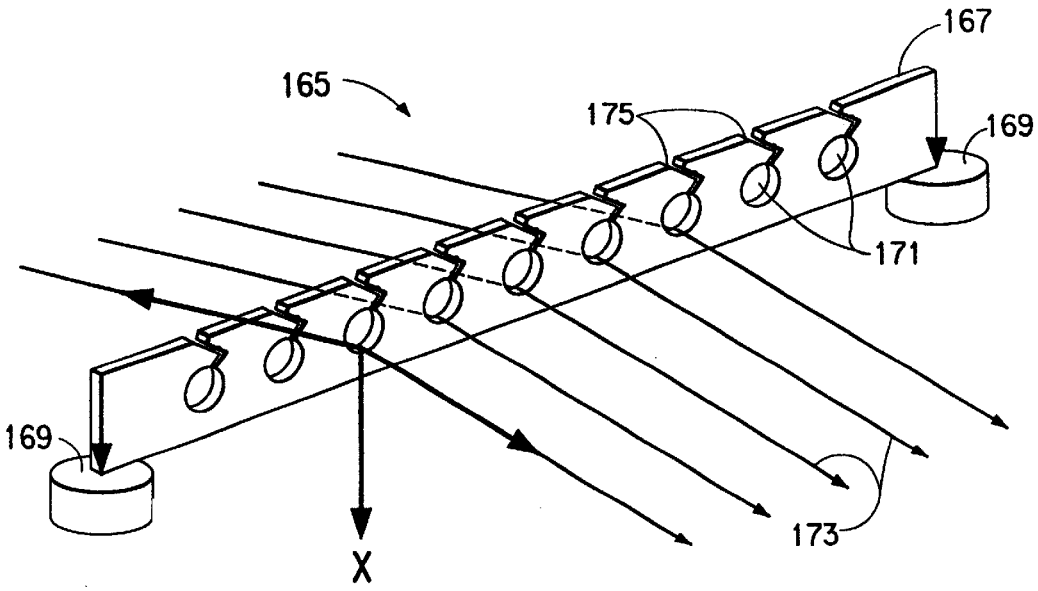
FIG. 17 is a view in perspective of the front guide and tension bar assembly of this invention.

However, it has been discovered that the operation of a beaming apparatus may be improved through an inventive front guide that is also a tension bar. Turning to FIG. 17, there is shown a front guide and tension bar assembly 165 that includes a bar 167 supported on both ends by means for measuring the pressure on bar 167. One example of the pressure measuring means are load cells 169. Front guide and tension bar assembly 165 is positioned on a support between a creel and a warper head. Bar 167 has a plurality of guides 171 formed therein, through which are fed a plurality of elastomeric yarns 173, with typically one yarn 173 passing through each guide 171.

In a beaming apparatus, there are usually multiple vertical rows or levels of wound elastomeric cakes in a creel, and there are usually at least two sides to the creel. There is typically one front guide for each row or level of wound elastomeric yarn for each side of the creel. If the creel is sufficiently long, there may be additional front guides positioned in the creel along the length thereof to support the yarn as it moves through the creel and towards the warper head.

The front guides of conventional beaming machines are positioned so that the yarn exerts at least some downward or upward force component on the front guide. A downward force component on bar 167 is represented by the letter "x" in FIG. 17. This occurs because the warper head usually is lower or higher than the front guides, and the tension on the yarn that causes the downward or upward force component helps to provide good winding of the yarn onto the warper head.

In the present invention, the vertical force component on bar 167 is measured by a pressure measuring means, such as load cells 169. The pressure measuring means sends a signal to control means or output means or both based upon the pressure on bar 167.

According to the present invention, there should be at least one front guide and tension bar assembly 165 having load cells 169 on each side of the creel. There is no limitation on the number of front guide and tension bar assemblies 165 that may be used in a creel. The front guide and tension bar assembly 165 may be used in the beaming apparatus of the invention disclosed herein as well as in any conventional beaming apparatus.

The use of front guide and tension bar assembly 165 greatly increases the quality control of the beaming process of a beaming apparatus because assembly 165 monitors the tension in a threadsheet of yarns 173 in the creel. The highest quality beams are those that are warped under a controlled, defined tension. By monitoring tension in yarn 173 in the creel using a device such as assembly 165, the mass flow of yarn 173 onto a beam may be regulated.

For example, it is well known that each cake of elastomeric yarn has an associated package relaxation curve which shows how the tension in the cake changes over time, and how the tension in the yarn changes from the edge of the cake to the core of the cake. In conventional beaming apparatuses, the beaming operation is controlled by the speed of rotation of the warper head, and thus it has been necessary in the past to create a compensation curve for the cake relaxation curve to allow the cake to be warped onto a beam at an appropriate speed so as to provide a high quality beam of warped elastomeric yarn. These relaxation curves and compensation curves for cakes of elastomeric yarn are difficult to prepare, and much time, effort and money has been spent in order to develop methods and computer programs to develop such curves.

When front guide and tension bar assembly 165 is used in a beaming apparatus, including a conventional beaming apparatus, and the tension in the yarn is monitored using assembly 165, there is no longer a need for such relaxation curves for cakes of elastomeric yarn, and thus there is no need to subsequently create compensation curves for those cakes. Instead of using laboriously created compensation curves to operate a conventional beaming apparatus, the compensation of the apparatus for cakes of elastomeric yarn can be effected automatically based on actual on-line monitored relaxation parameters.

Still referring to FIG. 17, in operation of a beaming apparatus constructed in accordance with the present invention including front guide and tension bar assembly 165, yarns 173 are pulled through openings 171 and exert a vertical force component on bar 167. The vertical force is measured by load cells 169, and a signal of the pressure on each end of bar 167 is sent to control means or output means or both. The control means may be used to adjust the parameters of operation of the beaming process depending on the pressure signal, such as by speeding up or slowing down the speed of rotation of the warper head. The output means displays the pressure on both ends of bar 167.

Load cells 169 in assembly 165 are calibrated so that if the tension on yarn 173 falls outside a predetermined first range, an alarm goes off to alert an operator to a potential problem in the warping process. Load cells 169 may also be calibrated so that if the tension in yarn 173 falls outside a predetermined second range, the second range being broader than the first range, a signal is sent to a control device instructing the warper head to stop.

Alternatively, pressure monitoring means may be placed between the pressure measuring means and the control means. The pressure monitoring means receives a signal from the pressure measuring means of the pressure on bar 167 and compares that pressure value to a predetermined range of pressure values. If the pressure value falls outside the predetermined range, the pressure monitoring means then sends a signal to either the control means to instruct the warper head to stop or to output means to alert an operator or both.

For a creel that has two or more sides, at least one assembly 165 is provided for each side of the creel. Thus, in addition to monitoring the tension on one side of the creel, a pair of assemblies 165 may also be used to detect relative differences in tension between the two sides of the creel. Assemblies 165 and their associated pressure monitoring means or output means may be calibrated to give an alarm if the difference in tension between the sides of the creel exceeds a predetermined amount.

Figure 18:
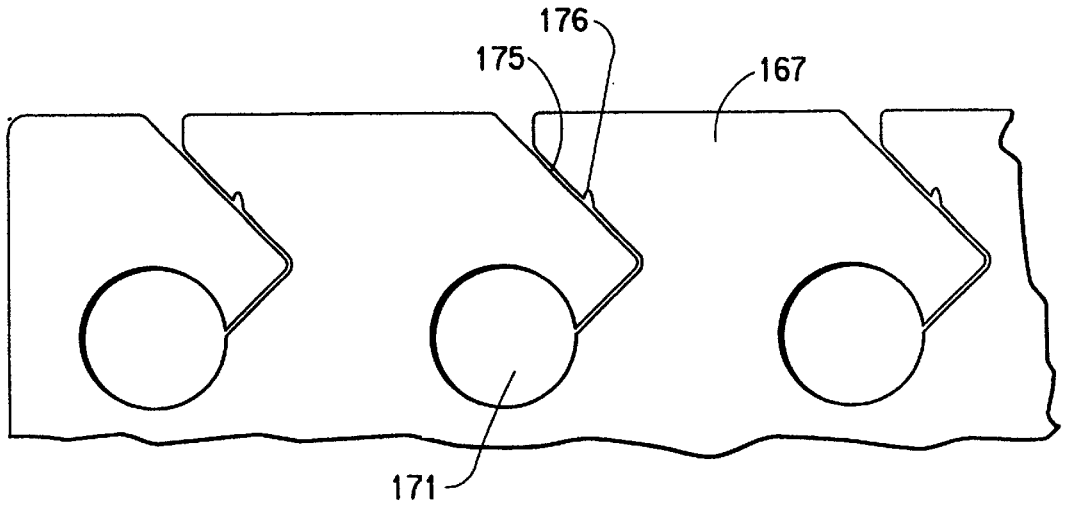
FIG. 18 is a front view in elevation of the front guide and tension bar assembly of FIG. 17.

Other features of the front guide assembly 165 are shown in FIG. 18. Turning to FIG. 18, there is shown bar 167 having slits 175 formed in bar 167 above each guide 171 to allow for more easy threading of yarns 173 into guides 171.

Conventional front guides are like pigtails, and need to be threaded like pigtails which is time consuming. Bar 167 of front guide and tension bar assembly 165 is threaded much easier and faster than conventional front guides because elastomeric yarn 173 need only be placed above slit 175 and the tension on yarn 173 causes yarn 173 to fall automatically into guide 171.

When being warped, yarn 173 tends to move up and down in guide 171, sometimes quite rapidly. To prevent yarn 173 from bouncing out of guide 171, slits 175 are preferably placed to a side of guide 171 and are angled so as to make it more difficult for yarn 173 to accidentally slip out of guide 171. In a more preferred embodiment, slit 175 further includes a notch 176 formed in a top surface of slit 175 to catch any yarn 173 that should accidentally slip out of guide 171.

Like thread guide 51, bar 167 may also be made of certain hardened metals such as described above. The advantage to bar 167 being made from a hardened metal is that assembly 165 may monitor the tension in threadsheet of yarns 173 without increasing the friction on yarns 173, in contrast to conventional front guides which are not made of such hardened metal and which are additional points of relatively high friction on yarns 173.

Pivoting Reed

After passing through the front guides, ends of yarn leave the creel and enter the warper head where the yarns pass through a reed. The reed is a comb-like structure that has a base and a plurality of needles connected to the base so as to define spaces therebetween through which the each of the yarns from the creel are passed. The purpose of the reed is to take the threadsheets from each front guide and place the ends on the same plane before the yarns are warped onto the beam.

One type of conventional reed, called a fan reed, has a plurality needles connected to a top bar and a bottom bar. The needles are angled towards the center of the top bar so that the total width of the needles at the top bar is smaller than the width at the bottom bar. The purpose of this structure is to allow the width of the threadsheet to be warped on the beam to be easily adjusted by raising the fan reed to increase the width of the threadsheet and by lowering the fan reed to decrease the width of the threadsheet.

The major disadvantage with the fan reed is that each end of yarn needs to be fed through each of the openings in the reed. A conventional beaming machine may warp between 1000 and 1600 ends, and it is very time consuming and laborious to take each end and put it through the narrow openings in the fan reed. On average, it takes about four hours by skilled workers to thread a complete fan reed with 1400 threads of yarn. Another disadvantage is that if one needle is damaged, the entire reed has to be replaced which is costly and leads to undesirable down time. Further, the new reed has to be completely rethreaded.

A second type of conventional reed is called an expansion reed where the needles are connected to a single bar on the bottom of the needles. Since the reed is open at the top, it is much faster to thread the reed; however, a disadvantage is that it is not possible to adjust the width of the threadsheet by raising and lowering the reed because if the-yarns are too close to the ends of the needles, the yarns may slip off the reed.

Therefore the open reed has a plurality of hinges that are parallel to its needles which allow the width of the reed to be adjusted. In effect, the reed is like an accordion in that the width of the reed may be increased and decreased by pulling the ends of the reed apart to open the hinges or by pushing the ends of the reed together to close the hinges.

In order to have a good quality beam of elastomeric yarn, the spacing of the yarn on the beam should be as uniform as possible. A problem with such a hinged open reed is that it is hard to get a good, equal spacing of the yarn that passes through the reed onto a beam. Still another problem is that the presence of the hinges on the reed interrupts the constant spacing of the needles across the reed, and thus makes it difficult to get a uniform spacing of yarn on the beam.

Still another problem with conventional open reeds is the fact that their individual needles are very thin, and these needles are inherently weak because they are supported only on one end. While needles in an open reed are easier to replace than needles in a fan reed, it would be preferred to have an open reed with stronger, i.e., thicker needles, but if the thickness of the needles increases too much it is not possible to obtain the number of desired yarn ends across the reed.

Figure 19:
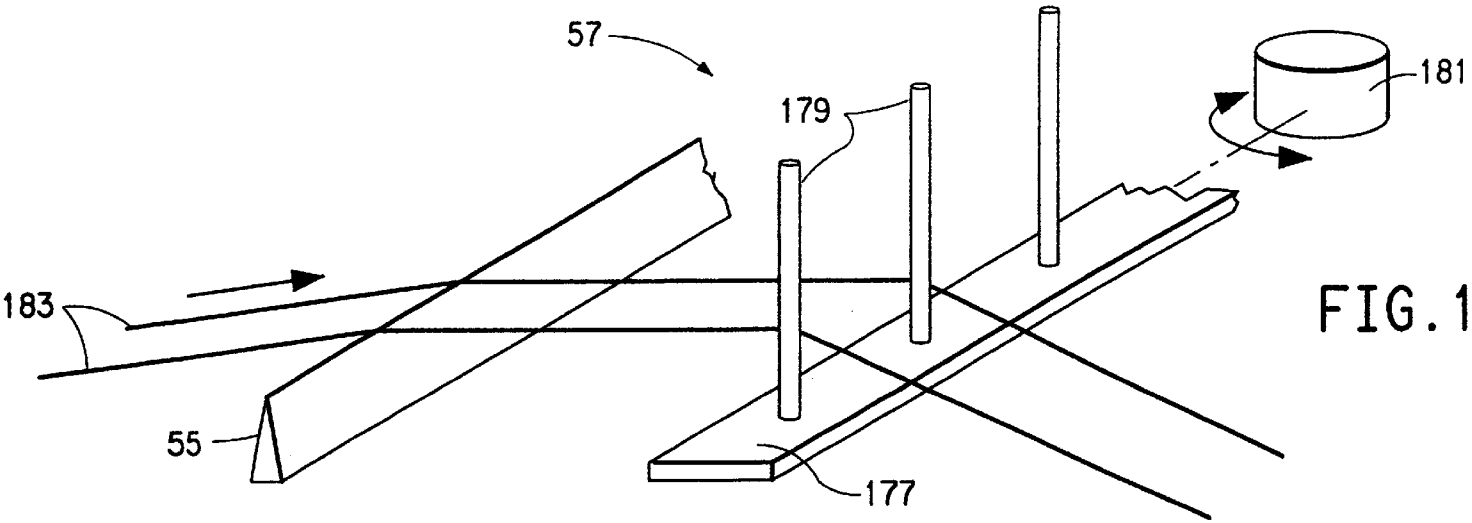
FIG. 19 is a view in perspective of a pivoting reed constructed in accordance with the present invention.

The present invention relates to a pivoting reed which overcomes the deficiencies of prior art reeds. Turning to FIG. 19, there is shown a pivoting reed 57 which includes a bar 177 having a plurality of vertical needles 179 mounted thereon. Bar 177 is connected to means 181 for pivoting bar 177. Pivoting means 181 may be a post having a hinge so that bar 177 may be pivoted around the post in the directions indicated by the double arrow.

Yarns 183 pass from the front guides of the creel to the warper head, where yarns 183 first contact the top surface of support blade 55 to put yarns 183 from each of the front guides onto a single plane. Next, each yarn 183 is threaded through a pair of needles 179 of reed 57. After leaving reed 57, yarns 183 pass over overrun roll 59 (not shown) and onto beam 61.

The angle $\phi$ of bar 177 with respect to an imaginary line parallel to the core of beam 61 is important to the operation of reed 57. In operation, when it is desired to change the breadth of the group of yarns, or threadsheet, as the group passes on to beam 61, bar 177 is pivoted by means 181 to change angle $\phi$.

Figure 20B:
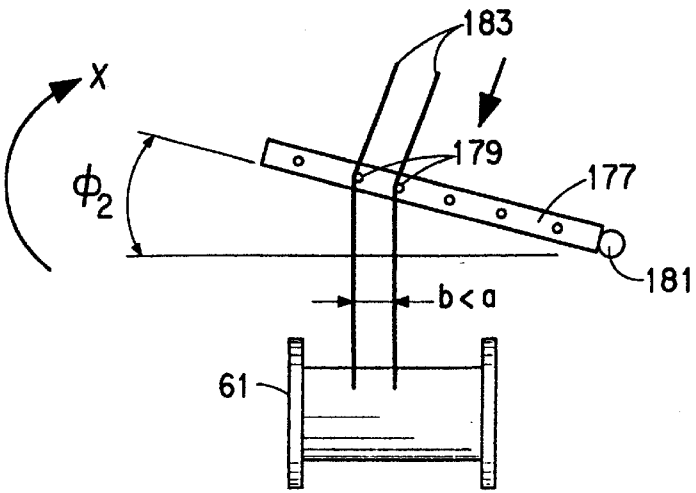
FIG. 20B is a top plan view of the pivoting reed of FIG. 19 showing the reed in an open position.
Figure 20A:
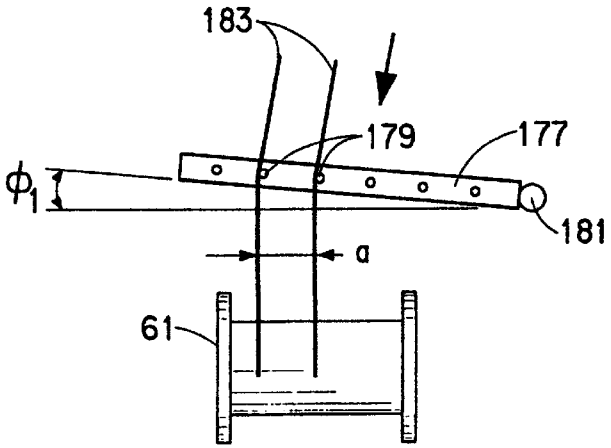
FIG. 20A is a top plan view of the pivoting reed of FIG. 19 showing the reed in a closed position.

Turning to FIG. 20A, there is shown pivoting reed 57 wherein bar 177 has been pivoted to an angle $\phi_1$, which produces a distance "a" between adjacent yarns 183 on beam 61. Note that overrun roll 59 has been omitted from FIGS. 20A and 20B for the sake of simplicity. As pivoting means 181 pivots bar 177 so that angle $\phi$ increases, the width of the threadsheet decreases. Turning to FIG. 20B, bar 171 has been pivoted to an angle $\phi_2$ which produces a distance "b" between adjacent yarns on beam 61 that is smaller than distance "a". Angle $\phi_2$ is greater than angle $\phi_1$, and thus it may be seen that as $\phi$ increases, the distance between adjacent yarns 183, and thus the width of the threadsheet of yarns 183 on beam 61, decreases.

Reed 57 has many advantages compared to prior art fan reeds and prior art open reeds. First, reed 57 provides a simple and fast way to adjust the width of a threadsheet of yarns 183 on a beam 61, while at the same time providing a relatively uniform distance between the yarns 183. In this way, reed 57 overcomes the disadvantages of prior art hinged reeds. In fact, the quality of the threadsheets produced using reed 57 is surprisingly high and unexpected in view of the prior art which taught that the distance from a reed to an overrun roll or a beam should be kept as small as possible in order to get a good separation of yarns on a beam. In fact, as angle $\phi$ increases, the distal end of bar 177, that is, the end opposite from pivoting means 181 shown in FIG. 19, moves farther away from beam 61. Nonetheless, despite the teachings of the prior art, the quality of threadsheets warped onto beam 61 are as good as or better than threadsheets warped onto beams using prior art reeds.

Another advantage of reed 57 is that it is very easy to thread. An experienced operator can thread 1000 to 1400 threads through reed 57 in about 20 minutes, which is much shorter that the approximate time of 4 man hours which is required to thread a conventional fan reed.

Figures 21, 22A, 22B, 22C, 22D:
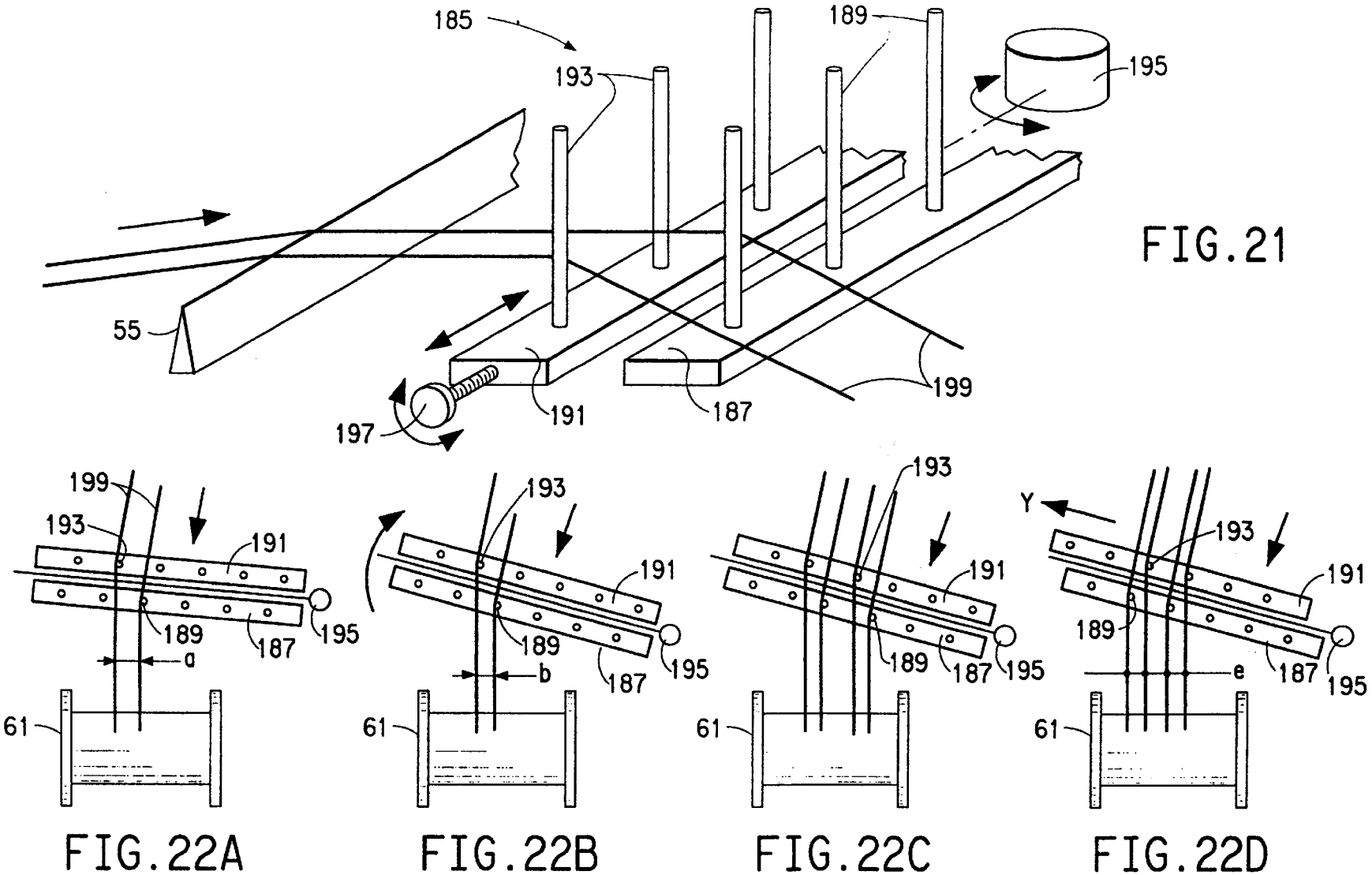
FIG. 21 is a view in perspective of another embodiment of a pivoting reed constructed in accordance with the present invention.
FIG. 22A is a top plan view of the pivoting reed of FIG. 21 showing the reed adjusted to give a desired width of yarn on a beam.
FIG. 22B is a top plan view of the pivoting reed of FIG. 21 showing the reed adjusted to give a desired width of yarn on a beam different from that of FIG. 22A.
FIG. 22C is a top plan view of the pivoting reed of FIG. 21 showing the reed in a condition where the yarn is not uniformly spaced apart.
FIG. 22D is a top plan view of the pivoting reed of FIG. 21 showing the reed adjusted to give a uniform width of yarn on a beam.

Another embodiment of the open reed of this invention is shown in FIG. 21. Turning to FIG. 21, there is shown a pivoting reed 185 which includes a first bar 187 having a plurality of vertical needles 189 and a second bar 191 having a plurality of vertical needles 193. Bars 187, 191 are connected to means 195 for pivoting bars 187, 191. Pivoting means 195 may be a post having a hinge so that bars 187, 191 may be pivoted around the post. Second bar 191 also includes means 197 for adjusting the longitudinal position of second bar 191 with respect to first bar 187 so as to change the relative spacing of needles 189, 193. Means 197 may be, for example, a rack and pinion or a threaded bolt which, when turned, moves against threads in a hole bored in bar 191.

Similar to pivoting reed 57 described above, yarns 199 pass from the front guides of the creel to the warper head, where yarns 199 first contact the top surface of support blade 55 to put yarns 199 from each of the front guides onto a single plane. Next, each yarn 199 is threaded through a pair of needles 193 of second bar 191 and then through a pair of needles 189 of first bar 187. After leaving reed 185, yarns 199 passes over overrun roll 59 (not shown) and onto beam 61.

As shown in FIGS. 22A and 22B, reed 185 may be pivoted by pivoting means 195 to change the angle $\phi$ of reed 185, and thus change the spacing of yarns 199 on beam 61 from a width "a", as shown in FIG. 22A, to a smaller width "b", as shown in FIG. 22B.

As the angle $\phi$ of reed 185 changes, yarns 199 move together in pairs, and this phenomenon occurs both when angle $\phi$ increases and when angle $\phi$ decreases. As may be seen in FIG. 22C, the change in angle $\phi$ causes two adjacent yarns 199 to move closer together. To compensate for this effect, the relative position of bars 189, 191 is changed by bar adjusting means 197 which moves second bar 191 as shown in FIG. 22D so as provide an equal spacing between output yarns 199 of the threadsheet to beam 61.

Pivoting reed 185 has all the same advantages as pivoting reed 57 described above, but is used when in cases where the needles of reed 185 need to be of such a thickness that there is insufficient space for them to be used in a single row such as in pivoting reed 57.

What is claimed is:

1. In a method for unwinding a cake of wound elastomeric yarn by unwinding elastomeric yarn in a creel, passing the elastomeric yarn over a bend in a thread guide and beaming the elastomeric yarn onto a bobbin in a warper head, the improvement which comprises positioning the bend in the thread guide so as to contact the elastomeric yarn passing over the bend and change the direction of the elastomeric yarn passing through the thread guide, said thread guide changing the direction of the elastomeric yarn no more than one time, attaching the thread guide to a base member so that a portion of the thread guide moves in response to changes in tension in the elastomeric yarn, said base member including means for monitoring the position of the thread guide, monitoring the position of the thread guide so that if the thread guide moves beyond a desired range in response to an increase in tension in the elastomeric yarn, the monitoring means generates an electrical signal.

2. The method of claim 1 wherein the thread guide is electrically conductive and the means for monitoring the position of the thread guide includes two spaced apart electrically conductive contacts so that when the tension on the thread guide exceeds a predetermined amount the thread guide contacts the electrically conductive contacts to generate an electrical signal.

3. The method of claim 1 wherein the step of attaching the thread guide to a base member includes providing means formed in the thread guide for allowing the length of the thread guide to be adjusted.

4. The method of claim 1 wherein the bend in the thread guide that contacts the elastomeric yarn is comprised of a surface-hardened metal.

5. The method of claim 4 wherein the bend of the thread guide is made from austenitic stainless steel.

6. The method of claim 4 wherein the bend of the thread guide is made from a metal having a Vickers Hardness of from 1000 up to 3000.

7. The method of claim 1 wherein the means for monitoring the position of the thread guide generates an electrical signal in response to the absence of tension in the elastomeric yarn passing through the thread guide.

* * * * *